US007841380B2

(12) United States Patent
Numano et al.

(10) Patent No.: US 7,841,380 B2
(45) Date of Patent: Nov. 30, 2010

(54) PRODUCING METHOD FOR MAGNESIUM ALLOY MATERIAL

(75) Inventors: Masatada Numano, Osaka (JP); Yoshihiro Nakai, Osaka (JP); Toshiya Ikeda, Osaka (JP); Taichiro Nishikawa, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 239 days.

(21) Appl. No.: 11/630,977

(22) PCT Filed: Jun. 28, 2005

(86) PCT No.: PCT/JP2005/011850

§ 371 (c)(1),
(2), (4) Date: Feb. 12, 2008

(87) PCT Pub. No.: WO2006/003899

PCT Pub. Date: Jan. 12, 2006

(65) Prior Publication Data

US 2008/0311423 A1 Dec. 18, 2008

(30) Foreign Application Priority Data

Jun. 30, 2004 (JP) ..... 2004-194844

(51) Int. Cl.

| | |
|---|---|
| ***B22D 11/00*** | (2006.01) |
| *B22D 11/06* | (2006.01) |
| *B22D 17/00* | (2006.01) |
| *C23F 3/00* | (2006.01) |
| *B23P 9/00* | (2006.01) |

(52) U.S. Cl. ..... 164/459; 148/538; 164/475; 164/480; 428/687

(58) Field of Classification Search ..... 164/459, 164/475, 480; 420/403, 404, 407–412, 414; 428/544, 687

See application file for complete search history.

(56) References Cited

U.S. PATENT DOCUMENTS 5,633,214 A * 5/1997 Nishio et al. ..... 501/96.4

(Continued)

FOREIGN PATENT DOCUMENTS

CN 1424418 6/2003

(Continued)

OTHER PUBLICATIONS

D. Eliezer et al. Advanced Performance Materials 5, 201-212 (1998) "Magnesium Science,Technology and Applications".*

(Continued)

*Primary Examiner*—Jessica L Ward
*Assistant Examiner*—Alexander Polyansky
(74) *Attorney, Agent, or Firm*—McDermott Will & Emery LLP

(57) ABSTRACT

A magnesium alloy material such as a magnesium alloy cast material or a magnesium alloy rolled material, excellent in mechanical characteristics and surface precision, a producing method capable of stably producing such material, a magnesium alloy formed article utilizing the rolled material, and a producing method therefor. The magnesium material producing method includes a melting step of melting a magnesium alloy in a melting furnace to obtain a molten metal, a transfer step of transferring the molten metal from the melting furnace to a molten metal reservoir, and a casting step of supplying a movable mold with the molten metal from the molten metal reservoir, through a pouring gate, and solidifying the molten metal to continuously produce a cast material. Parts are formed by a low-oxygen material having an oxygen content of 20 mass % or less. The cast material is given a thickness of from 0.1 to 10 mm.

34 Claims, 5 Drawing Sheets

U.S. PATENT DOCUMENTS

| | | | | |
|---|---|---|---|---|
| 6,015,528 | A * | 1/2000 | Bruski et al. | 266/207 |
| 6,667,263 | B1 * | 12/2003 | Guillo et al. | 501/96.4 |
| 2003/0159797 | A1 | 8/2003 | Yamasaki et al. | |
| 2004/0084173 | A1 * | 5/2004 | Nishikawa et al. | 164/482 |
| 2006/0225862 | A1 | 10/2006 | Haga et al. | |

FOREIGN PATENT DOCUMENTS

| | | | |
|---|---|---|---|
| DE | 102 01 592 | A1 | 10/2003 |
| DE | 10 2004 046 999 | | 4/2006 |
| JP | 4-333350 | | 11/1992 |
| JP | 2000-104136 | | 4/2000 |
| JP | 2003-326356 | | 11/2003 |
| JP | 2004-009110 | | 1/2004 |
| JP | 2004009110 | A * | 1/2004 |
| JP | 2004-060048 | | 2/2004 |
| JP | 3503898 | | 3/2004 |
| KR | 10-1979-0000854 | B1 | 7/1979 |
| WO | WO 02/083341 | A1 | 10/2002 |
| WO | WO 2004/020126 | A1 | 3/2004 |
| WO | WO 2004/076097 | A1 | 9/2004 |

OTHER PUBLICATIONS

Chinese Office Action, with English Translation, issued in Chinese Patent Application No. 200580022310.2, dated on Dec. 28, 2007.

Korean Office Action, w/ English translation thereof, issued in Korean Patent Application No. KR 10-2006-7027801 dated Feb. 17, 2009.

European Search Report issued in European Patent Application No. EP 05 75 5788, mailed Jul. 15, 2008.

Korean Office Action, w/ English translation thereof, issued in Korean Patent Application No. KR 10-2006-7027801 dated Dec. 17, 2009.

* cited by examiner

PRODUCING METHOD FOR MAGNESIUM ALLOY MATERIAL

RELATED APPLICATIONS

This application is a national phase of PCT/JP2005/011850 filed on Jun. 28, 2005, which claims priority from Japanese Application No. 2004-194844 filed Jun. 30, 2004, the disclosures of which Applications are incorporated by reference herein. The benefit of the filing and priority dates of the International and Japanese Applications is respectfully requested.

TECHNICAL FIELD

The present invention relates to a producing method for a magnesium alloy material, capable of stably producing a magnesium alloy material such as a magnesium alloy cast material or a magnesium alloy rolled material excellent in mechanical characteristics and surface quality, and a magnesium alloy material such as a magnesium alloy cast material or a magnesium alloy rolled material obtained by such producing method. It also relates to a molded magnesium alloy article obtained with the rolled material having the excellent characteristics above, and to a producing method therefor.

RELATED ART

Magnesium, having a specific gravity (density g/cm$^3$ at 20° C.) of 1.74, is a lightest metal among the metal materials utilized for structural purpose, and may be improved in strength by alloying with various elements. Also magnesium alloys, having relatively low melting points and requiring limited energy in recycling, are desirable from the standpoint of recycling, and are expected as a substitute for resinous materials. Therefore, use of magnesium alloys is recently increasing in small mobile equipment such as a mobile telephone or a mobile instrument, and automobile parts, requiring a reduced weight.

However, as magnesium and alloys thereof have an hcp structure poor in plastic working property, the currently commercialized magnesium alloy products are principally produced by a casting method utilizing an injection molding, such as a die casting method or a thixomolding method. However, the casting by the injection molding involves following drawbacks:

1. Poor in mechanical characteristics such as tensile strength, ductility and tenacity;
2. A poor material yield because of a large amount of parts unnecessary for the molded article, such as a runner for guiding the molten metal into the mold;
3. The molded article may involve a blow hole in the interior thereof, for example by a bubble involvement at the casting operation, and may therefore be subjected to a heat treatment after the casting;
4. Because of casting defects such as a flow line, a porocity and burs, a corrective or removing operation is necessary;
5. As a releasing agent coated on the mold sticks to the molded article, a removing operation is necessary; and
6. It is associated with a high manufacturing cost, because of an expensive manufacturing facility, presence of unnecessary parts and a removing operation required therefor.

On the other hand, a wrought material, prepared by a plastic working such as rolling or forging on a material obtained by casting, is superior in mechanical characteristics to a cast material. However, as the magnesium alloys are poor in the plastic working property as described above, it is investigated to execute the plastic working in a hot state. For example, patent references 1 and 2 disclose that a rolled material can be obtained by executing a continuous casting by supplying a movable mold, equipped with a pair of rolls, with a molten metal and applying a hot rolling on the obtained cast material.

Patent Reference 1: WO02/083341 pamphlet

Patent Reference 2: Japanese Patent No. 3503898

DISCLOSURE OF THE INVENTION

Problems to be Solved by the Invention

Along with the recent expansion of the field of application for the magnesium alloy products, the required quality level is becoming stricter, particularly for a lighter weight, an improved corrosion resistance and an improved external appearance. For example, for achieving a lighter weight, it is intended to utilize a complication in the shape such as utilizing a ribbed shape or changing a thickness locally, or to increase the strength of the product itself. Also for achieving an improved corrosion resistance, it is intended to optimize an element to be added and to optimize a surface treatment for the molded product. Also in the magnesium alloy products prepared by a prior casting method, although an ordinary painting is employed as the surface treatment, for the purpose of improving the impression of material, it is desired to utilizing so-called clear painting, serving as a protective film. However, these requirements are difficult to meet with the prior technologies mentioned above.

Therefore, a principal object of the present invention is to provide a producing method for a magnesium alloy material, capable of stably producing a magnesium alloy material excellent in mechanical characteristics and surface quality, and a magnesium alloy material, in particular a magnesium alloy cast material and a magnesium alloy rolled material, obtained by such producing method. Another object of the present invention is to provide a formed magnesium alloy article prepared with the rolled material, and a producing method therefor.

Means for Solving the Problems

According to the present invention, the aforementioned objects can be accomplished by specifying, in a continuous casting operation, a material constituting a part with which a molten magnesium alloy comes into contact.

More specifically, a producing method for the magnesium alloy of the invention includes:

a melting step of melting a magnesium alloy in a melting furnace to obtain a molten metal, a transfer step of transferring the molten metal from the melting furnace to a molten metal reservoir; and a casting step of supplying a movable mold with the molten metal from the molten metal reservoir, through a pouring gate, and solidifying the molten metal to continuously produce a cast material of a thickness of from 0.1 to 10 mm, wherein in the process from the melting step to the casting step, a part contacted by the molten metal is formed by a low-oxygen material having an oxygen content of 20 mass % or less.

In a prior continuous casting apparatus utilized for aluminum, an aluminum alloy, copper or a copper alloy, a crucible of a melting surface, a molten metal reservoir (tandish) for storing the molten metal from the crucible, a pouring gate for introducing the molten metal into the movable mold and the like are formed with ceramics excellent in a heat resistance and a heat insulation, such as silica (silicon oxide ($SiO_2$), oxygen content: 47 mass %), alumina (aluminum oxide ($Al_2O_3$), oxygen-content: 53 mass %), or calcium oxide (CaO, oxygen content: 29 mass %). On the other hand, in the continuous casting apparatus utilized for aluminum and the like, the movable mold is formed for example with stainless steel having an excellent strength. Therefore, a continuous casting of a magnesium alloy has utilized an apparatus, similar in constitution to the continuous casting apparatus utilized for the continuous casting of aluminum and the like. However, as a result of an investigation undertaken by the present inventors, it is found that, in the continuous casting of a magnesium alloy, a member constituted of an oxide as mentioned above, when used in a part contacted by the magnesium alloy, results in formation of magnesium oxide, which deteriorate a surface quality or gives rise to cracks when the obtained cast material is subjected to a secondary working such as a rolling.

Magnesium, constituting the principal component of magnesium alloys, is a very active metal, and its oxide or magnesium oxide (MgO) has a standard free energy of formation: −220 kcal/mol, which is smaller than that of oxides such as alumina, employed as a practical material. Therefore, in the case of employing a high-oxygen material principally constituted of oxygen, such as alumina or silica, in parts coming into contact with the molten metal, such as the crucible, the molten metal reservoir or the pouring gate, magnesium present as the principal component of the molten metal reduces such high-oxygen material, thus generating magnesium oxide. The magnesium oxide, not being re-dissolved, may be mixed in the cast material along the flow of the molten metal, thus leading to drawbacks such as causing an uneven solidification deteriorating the surface quality of the cast material, or constituting a foreign substance which induces a crack at a secondary working of the cast material such as a rolling thereby deteriorating the quality thereof, or which in a worst case inhibits the secondary working itself. Also a material deprived of oxygen may chipped and dissolved in the molten magnesium alloy, thereby locally lowering the temperature thereof and causing an uneven solidification, thus deteriorating the surface quality of the cast material. Based on such finding, the present invention specifies, in a continuous manufacture of a web-shaped cast material, to employ a material with a low oxygen content as the constituent material in a part contacted by the molten metal. The present invention will be clarified further in the following.

The present invention utilizes a continuous casting apparatus which executes a continuous casting, in order to obtain a substantially infinitely long magnesium alloy material (cast material). The continuous casting apparatus includes, for example, a melting furnace for melting a magnesium alloy to obtain a molten metal, a molten metal reservoir (tandish) for temporarily storing the molten metal from the melting furnace, a transfer gutter provided between the melting furnace and the molten metal reservoir, a pouring gate for supplying a movable mold with the molten metal from the reservoir, and a movable mold for casting the supplied molten metal. Also a molten metal dam (side dam) may be provided in the vicinity of the pouring gate, for preventing a leak of the molten metal from between the pouring gate and the movable mold. The melting furnace may be provided, for example, with a crucible for storing the molten metal and heating means provided around the crucible in order to melt the magnesium alloy. On an external periphery of a supply part, including the transfer gutter and the pouring gate, heating means is preferably provided in order to maintain the temperature of the molten metal. The movable mold may be, for example, (1) one constituted of a pair of rolls, as represented by a twin roll method, (2) one constituted of a pair of belts, as represented by a twin belt method, or (3) one formed by a combination of plural rolls (wheels) and a belt, as represented by a belt-and-wheel method. In such movable mold utilizing rolls and/or belts, a constant mold temperature is easy to maintain, and, as a surface coming into contact with the molten metal emerges continuously, a smooth and constant surface state is easy to maintain in the cast material. In particular, the movable mold preferably has a structure in which a pair of rolls, rotating in mutually different directions, are provided in an opposed relationship, namely a structure represented by (1) above, because of a high precision of mold preparation and because a mold surface (surface coming into contact with the molten metal) can be easily maintained at a constant position. Also in such structure, as a surface contacting the molten metal emerges continuously along the rotation of the roll, it is possible, within a period before a surface used for casting comes into again with the molten metal, to execute operations of applying a releasing agent and removing a deposit and to simplify equipment for executing such applying and removing operations.

The continuous casting apparatus above allows to provide a theoretically infinitely long cast material, whereby a mass production is rendered possible. In the invention, in order to reduce a coupling of the magnesium alloy with oxygen in executing such continuous casting, all the parts coming into contact with the molten metal are formed with a low-oxygen material, having an oxygen content of 20 mass % or less. All the parts coming into contact with the molten metal include, for example in the continuous casting apparatus above, at least surface parts of constituent members such as an interior of the melting furnace (particularly crucible), the supply part including the transfer gutter, the molten metal reservoir and the pouring gate, the movable mold and the molten metal dam. Naturally, such constituent members may be entirely formed by a low-oxygen material having an oxygen content of 20 mass % or less. In the invention, by forming parts, coming into contact with the molten metal in the steps from melting to casting, with the low-oxygen material described above, it is possible to reduce a formation of magnesium oxide or a chipping of the oxygen-deprived material, which lead to a deterioration in the surface properties and a deterioration in the working property in a secondary working such as a rolling on the cast material.

The low-oxygen material preferably has an oxygen content as low as possible, and the invention species 20 mass % as an upper limit in order to accomplish the intended objects above. More preferably the oxygen content is 1 mass % or less. In particular, a material substantially free from oxygen is preferable. Specific examples include at least one selected from a carbon-based material, molybdenum (Mo), silicon carbide (SiC), boron nitride (BN), copper (Cu), a copper alloy, iron, steel and stainless steel. Examples of the copper alloy include brass formed by a zinc (Zn) addition. Examples of the steel include stainless steel excellent in a corrosion resistance and a strength. Examples of the carbon-based material include carbon (graphite).

The movable mold is preferably formed with a material having an excellent thermal conductivity, in addition to a low oxygen content. In such case, as heat transmitted from the molten metal to the movable mold can be sufficiently rapidly absorbed in the mold, it is possible to effectively dissipate the heat of the molten metal (or solidified part), thereby producing a cast material of a uniform quality in the longitudinal direction in stable manner with a satisfactory productivity. As the thermal conductivity and the electrical conductivity are generally linearly correlated, the thermal conductivity may be replaced by the electrical conductivity. Therefore, a material meeting a following relation on electrical conductivity is proposed for a material for forming the movable mold:

(Condition for Electrical Conductivity)

$$100 \geqq y > x - 10$$

wherein y represents an electrical conductivity of the movable mold, and x represents an electrical conductivity of the magnesium alloy material.

Examples of material meeting such relation on electrical conductivity include copper, copper alloys and steel.

Also by forming a cover layer having an excellent thermal conductivity on a surface (surface contacting the molten metal) of the movable mold, similar effects can be obtained as in the case of forming the movable mold itself by the material having excellent thermal conductivity. More specifically, it is proposed to form a cover layer meeting a following relation on electrical conductivity:

(Condition for Electrical Conductivity)

$$100 \geqq y' > x - 10$$

wherein y' represents an electrical conductivity of a material constituting the cover layer, and x represents an electrical conductivity of the magnesium alloy material.

Examples of material meeting such relation on electrical conductivity include copper, copper alloys and steel. Such cover layer may be formed, for example, by coating powder of the aforementioned material, transferring a film of the aforementioned material, or mounting a ring-shaped member of the aforementioned material. In the case of forming the cover layer by coating or by transfer, it appropriately has a thickness of from 0.1 μm to 1.0 mm. A thickness less than 0.1 μm is difficult to provide a heat dissipating effect for the molten metal or the solidified part, while a thickness exceeding 1.0 mm results in a lowered strength of the cover layer itself or in a lowered adhesion to the movable mold, whereby a uniform cooling is difficult to attain. In the case of mounting a ring-shaped member, it preferably has a thickness of from about 10 to 20 mm, in consideration of the strength.

Also for forming the cover layer, a metal material, containing an alloy composition of the magnesium alloy constituting the cast material by 50 mass % or more, may also be employed. For example, there may be employed a material having a composition similar to the magnesium alloy constituting the cast material, or magnesium constituting the principal component of the magnesium alloy. A metal cover layer, utilizing a material of a composition similar or close to that of the magnesium alloy constituting the cast material, meets the condition on electrical conductivity as in the aforementioned cover layer having an excellent thermal conductivity, and can therefore achieve an effective heat dissipation in the molten metal and in the solidified part. Besides, it can improve a wetting property of the molten metal to the movable mold, thus providing an effect of suppressing a surface defect on the cast material.

At the casting operation, the movable mold preferably has a surface temperature equal to or lower than 50% of a melting point of the material constituting the movable mold. Such temperature range allows to prevent that the movable mold becomes softened and loses the strength, thereby allowing to obtain a long member of a stable shape. Also in such temperature range, the obtained cast material has a sufficiently low surface temperature, thus reducing a seizure and the like and providing a cast material of a satisfactory surface quality. Although the surface temperature of the movable mold is preferably as low as possible, the room temperature is selected as a lower limit, since an excessively low temperature causes a moisture deposition on the surface by a dewing phenomenon.

As explained above, by forming parts, coming into contact with the molten metal in the steps from melting to casting, with the low-oxygen material, it is possible to suppress the bonding of magnesium alloy with oxygen in these steps. In order to further reduce such bonding of magnesium alloy with oxygen, at least one of the interior of the melting furnace, the interior of the molten metal reservoir and the interior of the transfer gutter between the melting furnace and the reservoir is preferably maintained in a low-oxygen atmosphere. The magnesium alloy, when bonded with oxygen under a high temperature condition such as in a molten metal state, may vigorously react with oxygen and may cause a combustion. Therefore, in the melting furnace (particularly crucible) and the molten metal reservoir, storing the molten metal, and also in the transfer gutter, the oxygen concentration is preferably made lower and is preferably made at least less than the oxygen concentration in the air. It is advantageous to maintain both the interior of the melting furnace and the interior of the molten metal reservoir in a low-oxygen atmosphere. In particular, the atmosphere preferably contains oxygen of less than 5 vol %, and the remaining gas (other than oxygen) contains at least one of nitrogen, argon and carbon dioxide by 95 vol % or more. Oxygen is preferably present as little as possible. It may therefore be a gaseous mixture with three gases of nitrogen, argon and carbon dioxide, or with any two among nitrogen, argon and carbon dioxide, or with any one among nitrogen, argon and carbon dioxide. Also such atmosphere may further include an ordinary flame-resisting gas such as $SF_6$ or hydrofluorocarbon, thereby further enhancing the flame-resisting effect. The flame-resisting gas is preferably contained within a range of from 0.1 to 1.0 vol %.

In order to facilitate the aforementioned atmosphere and to avoid a deterioration of the work environment by a metal fume generated from the molten magnesium alloy, the melting furnace (particularly crucible) and the molten metal reservoir may be provided with an introducing pipe (inlet) for introducing the atmospheric gas and an exhaust pipe (outlet) for discharging such gas. Such structure allows to easily control an atmosphere, for example utilizing a purging gas which contains argon or carbon dioxide by 50 vol % or more, or a purging gas which contains argon and carbon dioxide by 50 vol % or more in total.

In the case of supplying the movable mold with the molten metal, the molten metal may cause a combustion by a reaction of the magnesium alloy with oxygen in the air, specifically in the vicinity of the pouring gate. Also the magnesium alloy, simultaneous with the casting into the mold, may be partially oxidized to shows a black coloration on the surface of the cast material. It is therefore desirable, like the melting furnace and the molten metal reservoir, to enclose the vicinity of the pouring gate and the movable mold and to fill a low-oxygen gas (that may contain a flat-resisting gas) therein. In the case without a gas shielding, the pouring gate may be constructed as an enclosed structure same as the cross-sectional shape of the movable mold, whereby the molten metal does not contact the external air in the vicinity of the pouring gate, thereby being prevented from combustion or oxidation and enabling to provide a cast material of a satisfactory surface state.

It is preferable to agitate the molten metal in a position where the flow of the molten metal tends to be stagnated, for example in at least one of the melting furnace (particularly crucible), the transfer gutter for transferring the molten metal from the melting furnace to the molten metal reservoir and the molten metal reservoir. The present inventors find that, when a molten magnesium alloy containing an additional element to be explained later is let to stand, such additional element component may sediment, as magnesium has a smaller specific gravity in comparison with aluminum or the like. It is also found that the agitation is effective in preventing segregation in the cast material and in obtaining a fine uniform dispersion of crystallizing substance. In anticipation for such prevention of sedimentation and segregation, it is proposed to agitate the molten metal in a place where the molten metal remains standing as in the melting furnace or the molten metal reservoir. Examples of the agitating method include a method of directly agitating the molten metal for example by providing a fin in the melting furnace or by introducing gas bubbles, and a method of indirectly agitating the molten metal by applying a vibration, an ultrasonic wave or an electromagnetic force from the exterior.

The molten metal, when supplied from the pouring gate to the movable mold (such pressure being hereinafter called a supply pressure), has preferably a pressure of equal to or larger than 101.8 kPa and less than 118.3 kPa (equal to or larger than 1.005 atm and less than 1.168 atm). With a supply pressure of 101.8 kPa or larger, the molten metal is effectively pressed to the mold, thereby achieving an easy shape control of a meniscus formed between the mold and the pouring gate (surface of the molten metal formed in a region from a distal end of the pouring gate to a position where the molten metal at first contacts the movable mold) and providing an effect of hindering formation of ripple marks. Particularly in the case of forming the movable mold with a pair of rolls, a distance of the meniscus-forming region (distance from the distal end of the pouring gate to the position where the molten metal at first contacts the movable mold) substantially becomes less than 10% of a distance (hereinafter called an offset) between a plane containing the rotary axes of the rolls and the distal end of the pouring gate, so that the molten metal contacts with the rollers, constituting the mold, over a wider range. Since the molten metal is principally cooled by the contact with the mold, a shorter region of the meniscus improves a cooling effect for the molten metal, thereby allowing to obtain a cast material having a uniform solidified structure in the transversal and the longitudinal directions. On the other hand, an excessively high supply pressure, specifically equal to or higher than 118.3 kPa, leads to drawbacks such as a molten metal leakage, so that the upper limit is selected as 118.3 kPa.

The application of the supply pressure to the molten metal may be executed, for example, in the case of the molten metal supply from the pouring gate to the movable mold by a pump, by controlling such pump, and, in the case of the molten metal supply from the pouring gate to the movable mold by the weight of the molten metal, by controlling the liquid level of the molten metal in the reservoir. More specifically, the movable mold is constituted of a pair of rolls which are so positioned that a center line of a gap between the rolls becomes horizontal; and the molten metal reservoir, the pouring gate and the movable mold are so positioned that the molten metal is supplied in a horizontal direction from the molten metal reservoir to the gap between the rolls through the pouring gate and the cast material is formed in the horizontal direction. In such state, by maintaining a liquid level of the molten metal in the molten metal reservoir at a position higher by 30 mm or more than the center line of the gap between the rolls, a supply pressure within a range as specified above may be given to the molten metal. The liquid level is advantageously so regulated that the supply pressure is equal to or larger than 101.8 kPa and smaller than 118.3 kPa, and an upper limit is about 1000 mm. It is preferable to select a height, higher by 30 mm or more from the center line of the gap between the rolls as a set value for the liquid level of the molten metal in the molten metal reservoir, and to control the liquid level in such a manner that the liquid level of the molten metal in the molten metal reservoir meets such set value exactly or within an error of ±10%. Such control range provides a stable supply pressure, thereby stabilizing the meniscus region and providing a cast material having a uniform solidified structure in the longitudinal direction.

The molten metal supplied to the gap between the rolls under such supply pressure has a high fill rate in the offset region. Therefore, a leakage of the molten metal may occur, in a closed space formed by a portion of the movable mold (rolls) initially contacted by the molten metal supplied from the pouring gate, a distal end of the pouring gate and a molten metal dam provided if necessary, from a position other than the position where the cast material is discharged. Therefore, the pouring gate is preferably positioned in such a manner that a gap between the movable mold (rolls) and the distal end of an external periphery of the pouring gate is 1.0 mm or less, particularly 0.8 mm or less.

The molten metal at the pouring gate preferably is maintained at a temperature equal to or higher than a melting point +10° C. and equal to or lower than a melting point +85° C. A temperature equal to or higher than a melting point +10° C. reduces viscosity of the molten metal flowing out from the pouring gate, thus allowing to easily stabilize the meniscus. Also a temperature equal to or lower than a melting point +85° C. does not excessively increase a heat amount deprived by the mold from the molten metal within a period from the contact of the molten metal with the mold to the start of solidification, and thus increases the cooling effect. Thus excellent effects are obtained, such as reducing a segregation in the cast material, forming a finer structure in the cast material, hindering formation of longitudinal flow lines on the surface of the cast material, and preventing an excessive temperature increase in the mold thereby stabilizing the surface quality in the longitudinal direction of the cast material. In certain alloy types, although the molten metal temperature at the melting may be elevated to about 950° C. at maximum in order to obtain a zero solid phase rate in the molten metal, at the supply of the molten metal from the pouring gate to the movable mold, a control within the aforementioned temperature range is preferable regardless of the alloy type.

In addition to the temperature control of the molten metal at the pouring gate, the molten metal is preferably controlled with a temperature fluctuation within 10° C. in a transversal cross-sectional direction of the pouring gate. A state with scarce temperature fluctuation allows to sufficiently fill the molten metal in lateral edge portions in the transversal direction of the cast material, thereby enabling to form a solidification shell, uniform in the transversal direction. It is thus possible to improve the surface quality and a product yield of the cast material. The temperature control may be executed by positioning temperature measuring means in the vicinity of the pouring gate for temperature management and by heating the molten metal by heating means when necessary.

A cooling rate, when the molten metal solidifies in contact with the movable mold, is preferably within a range of from 50 to 10,000 K/sec. A low cooling rate at the casting may generate coarse intermetallic compounds, thus hindering a secondary working such as a rolling. It is therefore preferable to execute a rapid cooling with a cooling rate as described above, in order to suppress a growth of the intermetallic compounds. The cooling rate may be regulated by regulating a target thickness of the cast material, a temperature of the molten metal and the movable mold and a drive speed of the movable mold, or by employing a material of an excellent cooling ability for the material of the mold, particularly the material of the mold surface contacted by the molten metal.

In the case of forming the movable mold with a pair of rolls, a distance (offset) between a plane including the rotary axes of the rolls and a distal end of the pouring gate is preferably 2.7% or less of an entire circumferential length of a roll. In such case, an angle (roll surface angle) formed about a rotary axis of the roll between a plane including the rotary axes of the rolls (radius of the roll) and the distal end of the pouring gate becomes 10° or less, thereby reducing cracks on the cast material. More preferably, the distance is from 0.8 to 1.6% of an entire circumferential length of a roll.

Also in the case of forming the movable mold with a pair of rolls, a distance between distal ends of an external periphery of the pouring gate is preferably from 1 to 1.55 times of a minimum gap between the rolls. In particular, a distance between portions of the rolls initially contacted by the molten metal (hereinafter called an initial gap) is preferably made from 1 to 1.55 times of the minimum gap. A gap (spacing), formed by an opposed positioning of the paired rolls constituting the movable mold, becomes gradually smaller from the pouring gate toward the casting direction, and, after a minimum gap where the rolls are positioned closest, becomes gradually larger. Thus, the distance of the distal ends of the external periphery of the pouring gate for supplying the movable mold with the molten metal, or preferably an initial gap including a point where the molten metal starts to contact the movable mold is maintained within such range, whereby, as the gap between the rolls decreases during the solidifying process, a gap is hardly formed between the molten metal (including a solidified part) and the mold and a high cooling effect is obtained. When the distance between the distal ends of the external periphery of the pouring gate (or the initial gap) exceeds 1.55 times of the minimum gap, the magnesium supplied from the pouring gate shows a larger contact portion with the movable mold. In such case, a solidification shell, generated in an initial phase of solidification after the start of solidification of the molten metal, may be subjected to a deforming force by the movable mold in the process until the completion of the solidification. The magnesium alloy, being a not easily workable material, may generate cracks by such deforming force whereby a cast material of a satisfactory surface quality is difficult to obtain.

The solidification of the molten metal is preferably completed at a discharge thereof from the movable mold. For example, in the case of forming the movable mold with a pair of rolls, the solidification of the molten metal is completed when it passes through the minimum gap where the rolls are positioned closest. More specifically, the solidification is so executed that a completion point of solidification exists within a region (offset section) between the plane including the rotary axes of the rolls and the distal end of the pouring gate. In the case of completing the solidification within such region, the magnesium alloy introduced from the pouring gate is in contact with the mold and is subjected to a heat deprivation by the mold, whereby a center line segregation can be prevented. On the other hand, an unsolidified region eventually contained in a central part of the magnesium alloy, after passing the offset section, constitutes a cause for a center line segregation or an inverse segregation.

In particular, the solidification is preferably completed within a range of from 15 to 60% of the offset distance, from a rear end (minimum gap position) of the offset section in the casting direction. When the solidification is completed within such region, a solidified part is subjected to a compression by the movable mold. Such compression allows to eliminate or reduce a void eventually present in the solidified part, and allows to obtain a cast material of a high density, having a sufficient working property in a secondary working such as a rolling. Also as a reduction by the movable mold after the complete solidification is less than 30%, defects such as a cracking caused by the reduction with the movable mold is scarcely or not at all experienced. Furthermore, the solidified part is still pinched between the rolls even after the complete solidification and is subjected to a heat deprivation, in a closed space formed by the rolls, by the mold (rolls), whereby the cast material at the discharge (release) from the mold has a sufficiently cooled surface temperature and is prevented from a loss in the surface quality for example by a rapid oxidation. Such completion of the solidification within the offset section may be achieved, for example, by suitably selecting the material of the mold in relation to a desired alloy composition and a desired plate thickness, by utilizing a sufficiently low mold temperature and regulating the driving speed of the movable mold.

In the case of controlling the solidification state in such a manner that the solidification is completed at the discharge from the movable mold, a surface temperature of the magnesium alloy material (cast material) discharged from the movable mold is preferably 400° C. or lower. Such condition allows to prevent a rapid oxidation of the cast material inducing a coloration, when the cast material is released from a closed section, between the movable mold such as rolls, to an oxygen-containing atmosphere (such as air). Also it can prevent an exudation from the cast material, in case the magnesium alloy contains an additional element to be explained later at a high concentration (specifically about 4 to 20 mass %). A surface temperature of 400° C. or lower may be realized, for example, by suitably selecting the material of the mold in relation to a desired alloy composition and a desired plate thickness, by utilizing a sufficiently low mold temperature and regulating the driving speed of the movable mold.

Also in the case of controlling the solidification state in such a manner that the solidification is completed at the discharge from the movable mold, while the solidified material is compressed by the movable mold until the release therefrom, a compression load applied to the movable mold by the material is, in a transversal direction of the material, preferably within a range of from 1,500 to 7,000 N/mm (from 150 to 713 kgf/mm). Until the solidification completion point, as a liquid phase remains in the material, a load is scarcely applied to the movable mold. Therefore, a load smaller than 1,500 N/mm indicates that the final solidification point exists in a position after the release from the movable mold, and, in such case, longitudinal flow lines or the like tend to be generated thereby causing a deterioration in the surface quality. Also a load exceeding 7,000 N/mm may possibly causes a cracking in the cast material, thus also deteriorating the quality. The compression load may be controlled by regulating the drive speed of the movable mold.

The present invention utilizes, for the purpose of improving mechanical characteristics, a magnesium alloy containing magnesium as a principal component and containing an additional element (first additional element, second additional element) to be explained later. More specifically, a composition containing magnesium (Mg) by 50 mass % or more is employed. More specific examples of the composition and the additional element are shown below. An impurity may be constituted of elements not intentionally added, or may include an element intentionally added (additional element):

1. a composition containing at least a first additional element, selected from a group of Al, Zn, Mn, Y, Zr, Cu, Ag and Si, in an amount equal to or larger than 0.01 mass % and less than 20 mass % per element, and a remainder constituted of Mg and an impurity;

2. a composition containing at least a first additional element, selected from a group of Al, Zn, Mn, Y, Zr, Cu, Ag and Si, in an amount equal to or larger than 0.01 mass % and less than 20 mass % per element, Ca in an amount equal to or larger than 0.001 mass % and less than 16 mass %, and a remainder constituted of Mg and an impurity;

3. a composition containing at least a first additional element, selected from a group of Al, Zn, Mn, Y, Zr, Cu, Ag and Si, in an amount equal to or larger than 0.01 mass % and less than 20 mass % per element, a second additional element, selected from a group of Ca, Ni, Au, Pt, Sr, Ti, B, Bi, Ge, In, Te, Nd, Nb, La and RE in an amount equal to or larger than 0.001 mass % and less than 5 mass % per element, and a remainder constituted of Mg and an impurity.

Although the first additional element is effective for improving characteristics of magnesium alloy such as a strength and a corrosion resistance, an addition exceeding the aforementioned range is undesirable as it results in an elevated melting point of the alloy or an increase in a semi-solid phase. Although Ca has an effect of providing the molten metal with a flame resistance, an addition exceeding the aforementioned range is undesirable as it generates coarse Al—Ca type intermetallic compounds and Mg—Ca type intermetallic compounds, thus deteriorating the secondary working property. Although the second additional element is anticipated to be effective in improving mechanical characteristics and providing the molten metal with a flame resistance for example by finer crystal grain formation, an addition exceeding the aforementioned range is undesirable as it results in an elevated melting point of the alloy or an increased viscosity of the molten metal.

The producing method utilizing the continuous casting described above allows to obtain a magnesium alloy cast material with an excellent surface property. The obtained cast material may be subjected to a heat treatment or an aging treatment, for obtaining a homogenization. Specific preferred conditions include a temperature of from 200 to 600° C. and a time of from 1 to 40 hours. The temperature and time may be suitably selected according to the alloy composition. In the present invention, the cast material obtained by the continuous casting above or the cast material subjected to a heat treatment after the continuous casting has a thickness of from 0.1 to 10.0 mm. With a thickness less than 0.1 mm, it is difficult to supply the molten metal in stable manner and to obtain a web-shaped member. On the other hand, a thickness exceeding 10.0 mm tends to cause a center-line segregation in the obtained cast material. The thickness is particularly preferably from 1 to 6 mm. The thickness of the cast material may be controlled by regulating the movable mold, for example, in case of forming the movable mold with a pair of rolls positioned in an opposed relationship, by regulating the minimum gap between the rolls. In the invention, the thickness above is obtained as an average value. An average value of the thickness is obtained, for example, by measuring a thickness in arbitrary plural positions in the longitudinal direction of the cast material and by utilizing such plural values. The method is same also in a rolled material to be explained later.

The obtained magnesium alloy cast material preferably has a DAS (dendrite arm spacing) of from 0.5 to 5.0 μm. A DAS within the range above provides an excellent secondary working property such as a rolling, and an excellent working property in case the secondary worked material is further subjected to a plastic working such as a pressing or a forging. A method for obtaining a DAS within the range above is, for example, to maintain the cooling rate at the solidification within a range of from 50 to 10,000 K/sec. In such case, it is more preferable to maintain a uniform cooling rate in the transversal and the longitudinal directions of the cast material.

Also the obtained magnesium alloy cast material, including an intermetallic compounds of a size of 20 μm or less, allows to further improve a secondary working property such as a rolling, and a working property in case the secondary worked material is further subjected to a plastic working such as a pressing or a forging. Further, a size of the intermetallic compounds of 10 μm or less allows to improve not only a deformation ability of the cast material in a secondary working and subsequent working steps, but also a heat resistance, a creep resistance, a Young's modulus, and an elongation. Further, a size of 5 μm or less is more preferable in achieving further improvements in the characteristics above. A material obtained under a further increased cooling rate and containing intermetallic compounds of 3 μm or less, finely dispersed in crystal grains, is improved in the characteristics above and the mechanical characteristics and is preferable. Furthermore, intermetallic compounds made 1 μm or less allow to further improve the characteristics and are preferable. A coarse intermetallic compounds exceeding 20 μm constitutes a starting point of a crack in the secondary working or plastic working as mentioned above. A method for obtaining a size of the intermetallic compounds of 20 μm or less is, for example, to maintain the cooling rate at the solidification within a range of from 50 to 10,000 K/sec. In such case, it is more preferable to maintain a uniform cooling rate in the transversal and the longitudinal directions of the cast material. It is more effective, in addition to the control of the cooling rate, to agitate the molten metal in the melting furnace or in the molten metal reservoir. In such case, the molten metal temperature is preferably so managed as not to become a temperature, causing a generation of a partial intermetallic compounds, or lower. The size of the intermetallic compounds is obtained for example by observing a cross section of the cast material under an optical microscope, then determining a largest cross-sectional length of the intermetallic compounds in such cross-section as the size of the intermetallic compounds on such cross section, similarly determining the size of the intermetallic compounds on arbitrary plural cross sections and adopting a largest value of the intermetallic compounds for example among 20 cross sections. The number of the observed cross sections may be changed suitably.

In the case that the magnesium alloy composition of the obtained cast material contains the first additional element and the second additional element above, each element, among the first and second additional elements, contained in 0.5 mass % or more preferably has a small difference (in absolute value), specifically 10% or less, between a set content (mass %) and an actual content (mass %) at a surface part and a central part of the cast material, for obtaining an excellent working property in a secondary working such as a rolling or when the secondary worked material is subjected to a plastic working such as a pressing or a forging. In a survey of an influence of a segregation of an element, contained by 0.5 mass % or more in the magnesium alloy, on the working property in a secondary working such as a rolling or when the material is further subjected to a plastic working such as a pressing, the present inventors find that a difference between the set content and the actual content exceeds 10% at the surface part and the central part of the cast material induces an unbalance in the mechanical characteristics between the surface part and the central part, whereby a breaking easily occurs starting from a relatively fragile part and a forming limit is therefore lowered. Therefore, for each element contained in 0.5 mass % or more, a difference between the set content and the actual content at a surface part of the cast material, and a difference between the set content and the actual content at a central part of the cast material, are made 10% or less. A surface part of the cast material means, in a thickness direction on a cross section of the cast material, a region corresponding to 20% of the thickness of the cast material from the surface, and a central part means, in a thickness direction on a cross section of the cast material, a region corresponding to 10% of the thickness of the cast material from the center. The constituent components may be analyzed for example by an ICP. The set content may be a blending amount for obtaining the cast material, or a value obtained by analyzing the entire cast material. The actual content of the surface part may be obtained, for example, by cutting or polishing a surface to expose a surface part, executing analyses on cross sections at five or more different positions in such surface part, and taking an average of the analyzed values. The actual content of the central part may be obtained, for example, by cutting or polishing a surface to expose a central part, executing analyses on cross sections at five or more different positions in such central part, and taking an average of the analyzed values. The number of positions for analyses may be changed suitably. A method for obtaining a difference of 10% or less is, for example, to utilize a sufficiently fast casting speed, or to apply a heat treatment to the cast material at a temperature of from 200 to 600° C.

Further, a depth of a surface defect of the obtained cast material is preferably less than 10% of a thickness of the cast material. In a survey of an influence of a depth of a surface defect on a secondary working property and a plastic working property, the present inventors find that a surface defect, having a depth less than 10% of the thickness of the cast material, hardly becomes a start point of a crack particularly in case of a folding work by a pressing, thus improving the working property. Therefore, a depth of the surface defect is defined as above. In order to obtain a depth of the surface defect less than 10% of the thickness of the cast material, it is possible, for example, to adopt a lower molten metal temperature and to adopt a higher cooling rate. It is also possible to utilize a movable mold, provided with a metal cover layer excellent in thermal conductivity and wetting property of the molten metal on the movable mold, or to maintain a temperature fluctuation in the molten metal temperature, in a transversal cross-sectional direction of the pouring gate, at 10° C. or less. A depth of a surface defect may be determined, by selecting arbitrary two points within a region of a length of 1 m in the longitudinal direction of the cast material, preparing cross sections of such two points, polishing each cross section with an emery paper of #4000 or finer and diamond grinding particles of a particle size of 1 μm, observing the surface over an entire length under an optical microscope of a magnification of 200× and defining a largest value as the depth of the surface defect.

In addition, ripple marks present on the surface of the cast material preferably satisfies a relation $rw \times rd < 1.0$ for a maximum width rw and a maximum depth rd, for reducing a loss in the plastic working property in a magnesium alloy material subjected to a secondary working. The relation $rw \times rd < 1.0$ may be satisfied, for example, by maintaining a molten metal pressure (supply pressure), when supplied from the pouring gate to the movable mold, equal to or larger than 101.8 kPa and less than 118.3 kPa (equal to or larger than 1.005 atm and less than 1.168 atm), or by regulating the drive speed of the movable mold. An excessively low drive speed of the mold tends to enlarge the ripple marks, while an excessively high drive speed may lead to a surface cracking and the like. A maximum width and a maximum depth of the ripple marks is obtained by measuring, on the ripple marks present on the surface of the cast material, a maximum width and a maximum depth with a three-dimensional laser measuring equipment, on arbitrary 20 ripple marks with a predetermined measuring range. In the case that plural measuring ranges are defined on a cast material, the maximum width and the maximum depth are determined in a similar manner in each measuring range and such maximum width and maximum depth satisfy the aforementioned relation in all the measuring ranges, such cast material has a better effect of decreasing the loss in the plastic working property. A number of the measuring ranges is preferably from 5 to 20.

Also the obtained cast material preferably has a tensile strength of 150 MPa or higher and a breaking elongation of 1% or higher as it can reduce a loss in the plastic working property of the magnesium alloy material subjected to a secondary working. In order to improve the strength and the ductility, it is preferable to form a finer structure and to reduce a size of surface defects, thereby enabling the cast material to be depressed. More specifically, a cast material having the above-defined mechanical characteristics may be obtained, for example, by selecting DAS within a range of from 0.5 to 5.0 μm, a size of the intermetallic compounds within a range of 20 μm or less, a depth of the surface defects within a range of 10% or less of the material thickness, and setting the solidification completion point within a range of from 15 to 60% of the offset distance.

The cast material obtained by the continuous casting or the cast material subjected to a heat treatment after the continuous casting has an excellent secondary working property in a rolling or the like, and is therefore optimum as a material for a secondary working. Also a magnesium alloy material of a better strength may be obtained by subjecting such cast material to a plastic working, such as a rolling by a pair of rolling rolls.

The rolling is preferably executed under a condition of a total reduction rate of 20% or higher. In a rolling with a total reduction rate less than 20%, columnar crystals constituting the structure of the cast material remain, thereby tending to show uneven mechanical characteristics. In particular, for converting the cast structure into a substantially rolled structure (re-crystallized structure), the total reduction rate is preferably selected as 30% or higher. The total reduction rate C is defined by $C\ (\%)=(A-B)/A\times 100$, for a thickness A (mm) of the cast material and a thickness B (mm) of the rolled material.

The rolling may be executed in one pass, or in plural passes. In the case of executing a rolling of plural passes, it preferably includes a rolling pass having a one-pass reduction rate of from 1 to 50%. When a one-pass reduction rate is less than 1%, a number of repeated rolling passes increases for obtaining a rolled material (rolled plate) of a desired thickness, thus resulting in a longer time and a lower productivity. Also in case the reduction rate in one pass exceeds 50%, because of a large working level, it is desired to adequately heat the material prior to the rolling, thereby increasing the plastic working property. However, such heating generates a coarser crystal structure, thus possibly deteriorating the plastic working property in a pressing or a forging. A reduction rate c is defined by $c\ (\%)=(a-b)/a\times 100$, for a thickness a (mm) of the material before rolling and a thickness b (mm) of the material after rolling.

Also the rolling process may include a rolling step in which a temperature T (° C.), which is a higher one of a temperature t1 (° C.) of the material before the rolling and a temperature t2 (° C.) of the material at the rolling, and a reduction rate c (%) satisfy a relation 100>(T/c)>5. In a case that (T/c) is equal to or larger than 100, the rolling operation is executed with a low working level in spite of a fact the material has a sufficient rolling property because of a high temperature and allows to adopt a high working level, so that the operation is wasteful economically. In a case that (T/c) is equal to or less than 5, the rolling operation is executed with a high working level in spite of a fact the material has a low rolling property because of a low temperature, so that cracks are easily generated at the rolling on the surface or in the interior of the material.

Furthermore, the rolling process preferably includes a rolling step in which a surface temperature of the material is 100° C. or less immediately before introduction into the rolling rolls and a surface temperature of the rolling rolls is from 100 to 300° C. The material is indirectly heated by a contact with thus heated rolling rolls. In the following, a rolling method, in which the material before rolling is maintained at a surface temperature of 100° C. or less and the rolling rolls at an actual rolling operation are heated to a surface temperature of from 100 to 300° C., is called "non-preheat rolling". The non-preheat rolling may be executed in plural passes, or may be applied in a last pass only, after executing a rolling, other than the non-preheat rolling, in plural passes. Stated differently, it is possible to utilize the rolling, other than the non-preheat rolling, as a crude rolling and the non-preheat rolling as a finishing rolling. The non-preheat rolling executed at least in a last pass allows to obtain a magnesium alloy rolled material, having a sufficient strength and excellent in the plastic working property.

In the non-preheat rolling, the surface temperature of the material immediately before introduction into the rolling rolls is not particularly restricted in a lower limit, and a material at the room temperature does not require a heating or a cooling, and is advantageous for energy efficiency.

In the non-preheat rolling, a temperature of the rolling rolls lower than 100° C. results in an insufficient heating of the material, thus eventually generating a crack in the course of rolling and inhibiting the rolling operation. Also in case the rolling rolls have a temperature exceeding 300° C., a large-scale heating facility is required for the rolling rolls, and the temperature of the material in the course of rolling becomes excessively high to form coarser crystal structure, thus tending to deteriorate the plastic working property as in a pressing or a forging.

The rolling other than the non-preheat rolling is preferably a hot rolling in which the material is heated to a temperature of from 100 to 500° C., particularly preferably from 150 to 350° C. A reduction rate per one pass is preferably from 5 to 20%.

The rolling work, when executed continuously in succession to the continuous casting, can utilize a heat remaining in the cast material, and is excellent in the energy efficiency. In case of a warm rolling, the material may be heated indirectly by providing the rolling rolls with heating means such as a heater, or directly by positioning a high frequency heating apparatus or a heater around the material. The rolling work is advantageously executed utilizing a lubricating agent. Use of a lubricating agent allow to improve, by a certain extent, a tenacity such as a bending ability in the obtained magnesium alloy rolled material. For the lubricating agent, an ordinary rolling oil may be utilized. The lubricating agent is advantageously utilized, by coating on the material prior to the rolling. In a case of not executing the rolling work in succession to the continuous casting or executing a finishing rolling, the material is preferably subjected, prior to the rolling, to a solution treatment for 1 hour or longer at a temperature of from 350 to 450° C. Such solution treatment allows to remove a residual stress or a strain introduced by a work preceding the rolling, such as a crude rolling, and to reduce a textured structure formed in such preceding work. It also allows, in a succeeding rolling operation, to prevent unexpected cracking, distortion or deformation in the material. A solution treatment executed at a temperature lower than 350° C. or for a period less than 1 hour has little effect for sufficiently removing the residual stress or reducing the textured structure. On the other hand, a temperature exceeding 450° C. results in a saturation of effects for example for removing the residual stress, and leads to a waste of the energy required for the solution treatment. An upper limit time for the solution treatment is about 5 hours.

Also the magnesium alloy rolled material, subjected to the rolling work above, is preferably subjected to a heat treatment. Also in the case of executing the rolling in plural passes, a heat treatment may be applied for every pass or every plural passes. Conditions for the heat treatment include a temperature of from 100 to 600° C. and a time of from about 5 minutes to 40 hours. In order to improve the mechanical characteristics by removing a residual stress or a strain, introduced by a rolling work, a heat treatment may be applied at a low temperature (for example from 100 to 350° C.) within the aforementioned temperature range and for a short time (for example about minutes to 3 hours) within the aforementioned time range. An excessively low temperature or an excessively short time results in an insufficient recrystallization whereby the strain persists, while an excessively high temperature or an excessively long time results in excessively coarse crystal grains, thus deteriorating the plastic working property for example in a pressing or a forging. In the case of executing a solution treatment, a heat treatment may be executed at a high temperature (for example from 200 to 600° C.) within the aforementioned temperature range and for a long time (for example about 1 to 40 hours) within the aforementioned time range.

A magnesium alloy rolled material, subjected to a rolling work above and in particularly a heat treatment thereafter, has a fine crystal structure, and excellent in a strength and a tenacity, and in plastic working property as in a pressing or a forging. More specifically, a fine crystal structure with an average crystal grain size of from 0.5 μm to 30 μm. Although an average crystal grain size less than 0.5 μm improves the strength, it is saturated in the effect of tenacity improvement, while an average crystal grain size exceeding 30 μm reduces the plastic working property due to presence of coarse grains constituting start points of cracking and the like. The average crystal grain size may be obtained by determining, on a surface part and a central part of the rolled material, a crystal grain size by a cutting method as defined in JIS G0551 and obtaining an average value. A surface part of the rolled material means, in a thickness direction on a cross section of the rolled material, a region corresponding to 20% of the thickness of the rolled material from the surface, and a central part means, in a thickness direction on a cross section of the rolled material, a region corresponding to 10% of the thickness of the rolled material from the center. The average crystal grain size may be varied by regulating rolling conditions (such as a total reduction rate and a temperature) or heat treatment conditions (such as a temperature and a time).

A difference (in absolute value) between an average crystal grain size in a surface part of the rolled material and an average crystal grain size in a central part thereof, being at 20% or less, allows to further improve the plastic working property as in a pressing or in a forging. In case such difference exceeding 20%, an uneven structure leads to uneven mechanical characteristics, thus resulting in a lowered forming limit. A difference of the average crystal grain size of 20% or less may be realized by executing a non-preheat pressing in at least a last pass. It is thus preferable to uniformly introduce a strain, by a rolling at a low temperature.

Also in the obtained magnesium alloy rolled material, a size of the intermetallic compounds of 20 μm or less allows to further improve the plastic working property as in a pressing or in a forging. Coarse intermetallic compounds exceeding 20 μm constitute starting points of a cracking in the plastic working. A size of the intermetallic compounds of 20 μm or less may be obtained, for example, by utilizing a cast material having a size of the intermetallic compounds of 20 μm or less.

In the case that the magnesium alloy composition of the obtained rolled material contains the first additional element and the second additional element above, each element, among the first and second additional elements, contained in 0.5 mass % or more preferably has a small difference (in absolute value), specifically 10% or less, between a set content (mass %) and an actual content (mass %) at a surface part and a central part of the rolled material, for obtaining an excellent plastic working property as in a pressing or a forging. A difference between the set content and the actual content exceeding 10% induces an unbalance in the mechanical characteristics between the surface part and the central part, whereby a breaking easily occurs starting from a relatively fragile part and a forming limit is therefore lowered. The analysis of the composition component may be executed in the same manner as in the case of the cast material. Also for obtaining such difference between the set content and the actual content of 10% or less, there may be utilized a cast material in which the difference between the set content and the actual content at the surface part of the cast material and the difference between the set content and the actual content at the central part are both 10% or less.

Further, the obtained rolled material preferably has a thickness of a surface defect, less than 10% of the thickness of the rolled material. A surface defect, having a depth less than 10% of the thickness of the rolled material, hardly becomes a start point of a crack particularly in case of a folding work by a pressing, thus improving the working property. In order to obtain a depth of the surface defect less than 10% of the thickness of the rolled material, it is possible, for example, to utilize a cast material in which the depth of the surface defect is less than 10% of the thickness of the cast material. The depth of the surface defect may be measured in the same manner as in the case of the cast material.

Also the obtained rolled material preferably has a tensile strength of 200 MPa or higher and a breaking elongation of 5% or higher as it can reduce a loss in the plastic working property as a pressing or a forging. In order to obtain such strength and tenacity, it is possible, for example, to utilize a cast material having a tensile strength of 150 MPa or higher and a breaking elongation of 1% or higher.

The rolled material above has an excellent working property in a plastic working such as a pressing or a forging, and is therefore optimum as a material for a plastic working. Also an application of a plastic working such as a pressing to the rolled material above enables applications in various fields requiring a light weight.

As specific conditions of the plastic working, it is preferably conducted in a state of an increased plastic working property, by heating the rolled material to a temperature equal to or higher than the room temperature and lower than 500° C. Examples of the plastic working include a pressing and a forging. After the plastic working, a heat treatment is preferably applied. Conditions for the heat treatment include a temperature of from 100 to 600° C. and a time of from about 5 minutes to 40 hours. In the case of removing a strain caused by the working, removing a residual stress introduced at the working or improving the mechanical characteristics, a heat treatment may be applied at a low temperature (for example from 100 to 350° C.) within the aforementioned temperature range and for a short time (for example about 5 minutes to 24 hours) within the aforementioned time range. In the case of executing a solution treatment, a heat treatment may be executed at a high temperature (for example from 200 to 600° C.) within the aforementioned temperature range and for a long time (for example about 1 to 40 hours) within the aforementioned time range. A magnesium alloy molded article, obtained by such plastic working and heat treatment, may be utilized in structural members and decorative articles in the fields relating to household electric appliances, transportation, aviation-space, sports-leisure, medical-welfare, foods, and construction.

EFFECT OF THE INVENTION

As explained above, the producing method of the present invention for the magnesium alloy material provides an excellent effect of providing a magnesium alloy material excellent in mechanical characteristics such as a strength and a tenacity and in surface properties, in stable manner at a low cost. Also an obtained magnesium alloy cast material is a material excellent in a secondary working property such as a rolling, and a magnesium alloy rolled material, obtained utilizing the cast material, is a material excellent in a plastic working property as in a pressing or a forging. Also a magnesium alloy molded article, obtained utilizing the rolled material, has a high strength and a light weight, and is usable as a structural member in various fields.

BEST MODE FOR CARRYING OUT THE INVENTION

Figure 1:
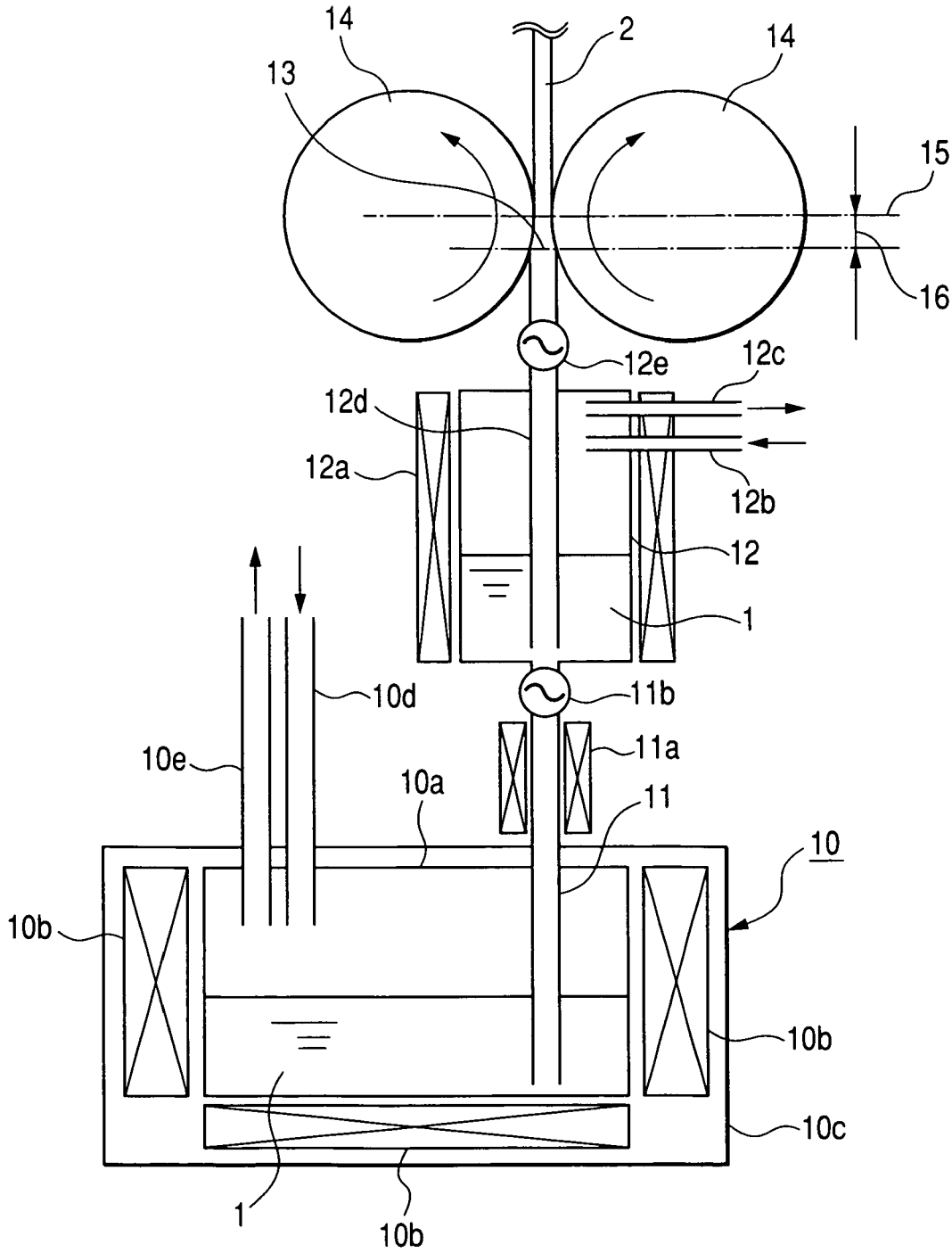
FIG. 1 is a schematic view of a continuous casting apparatus for a magnesium alloy.

In the following, embodiments of the present invention will be explained with reference to the accompanying drawings. In the drawings, same components are represented by same symbols and will not be explained in duplication. Also dimensional ratios in the drawings doe not necessarily match those in the description.

FIG. 1 is a schematic view of a continuous casting apparatus for a magnesium alloy. The continuous casting apparatus includes a pair of rolls 14 as a movable mold, and produces a cast material by supplying the movable mold with a molten metal 1 of a magnesium alloy, utilizing a pump 11*b* and a pump 12*e*. The apparatus is equipped with a melting furnace 10 for melting a magnesium alloy to form a molten metal 1, a molten metal reservoir 12 for temporarily storing the molten metal 1 from the melting furnace 10, a transfer gutter 11 provided between the melting furnace 10 and the molten metal reservoir 12 for transporting the molten metal 1 from the melting furnace 10 to the molten metal reservoir 12, a supply part 12*d* including a pouring gate 13 for supplying the molten metal 1 from the molten metal reservoir 12 to a gap between a pair of rolls 14, and a pair of rolls 14 for casting the supplied molten metal 1 thereby forming a cast material 2.

In the example shown in FIG. 1, the melting furnace 10 includes a crucible 10*a* for melting the magnesium alloy and storing the molten metal 1, a heater 10*b* provided on the external periphery of the crucible 10*a* for maintaining the molten metal 1 at a constant temperature, and a casing 10*c* storing the crucible 10*a* and the heater 10*b*. Also a temperature measuring device (not shown) and a temperature controller (not shown) are provided for regulating the temperature of the molten metal 1. Also the crucible 10*a* is provided, for controlling an atmosphere in the interior thereof by a gas to be explained later, with a gas introducing pipe 10*d*, an exhaust pipe 10*e* and a gas controller (not shown). Also the crucible 10*a* is equipped with a fin (not shown) for agitating the molten metal 1 thereby rendered capable of agitation.

In the example shown in FIG. 1, the transfer gutter 11 is inserted at an end thereof into the molten metal 1 in the crucible 10*a* and connected at the other end to the molten metal reservoir 12, and is provided on an external periphery with a heater 11*a* in order that the temperature of the molten metal 1 is not lowered in transporting the molten metal 1. Also a pump 11*b* is provided for supplying the molten metal 1 to the molten metal reservoir 12. On an external periphery of the transfer gutter 11, an ultrasonic agitating apparatus (not shown) is provided, thereby enabling to agitate the molten metal 1 during the transport.

In the example shown in FIG. 1, the molten metal reservoir 12 is equipped, on an external periphery thereof, with a heater 12*a*, a temperature measuring instrument (not shown) and a temperature controller (not shown). The heater 12*a* is principally used at the start of operation, for heating the molten metal reservoir 12 in order that the molten metal 1 transported from the melting furnace 10 is maintained at least at a non-solidifying temperature. During a stable operation, the heater 12*a* may be suitably used in consideration of a heat input from the molten metal 1 transferred from the melting furnace 10 and a heat output dissipated from the molten metal reservoir 12. Also as in the crucible 10*a*, the molten metal reservoir 12 is provided, for the purpose of atmosphere control by a gas, with a gas introducing pipe 12*b*, an exhaust pipe 12*c* and a gas controller (not shown). Also, as in the crucible 10*a*, the molten metal reservoir 12 is equipped with a fin (not shown) for agitating the molten metal 1 thereby rendered capable of agitation.

In the example shown in FIG. 1, the supply part 12*d* is inserted, at an end thereof, into the molten metal 1 of the molten metal reservoir 12, and is provided, at the other end (at a side of the rolls 14 constituting the movable mold), with a pouring gate 13. In the vicinity of the pouring gate 13, a temperature measuring device (not shown) is provided for a temperature management of the molten metal 1 supplied to the pouring gate 13. The temperature measuring device is so positioned as not to hinder the flow of the molten metal 1. The pouring gate 13 is provided separately with heating means such as a heater and is preferably heated, before the operation is started, to a temperature range in which the molten metal 1 does not solidify. Also in order to reduce a temperature fluctuation of the molten metal 1 in a transversal cross-sectional direction of the pouring gate 13, it is possible to confirm the temperature suitably with the temperature measuring device and to heat the pouring gate 13 by the heating means. The temperature fluctuation may also be reduced by forming the pouring gate 13 with a material having an excellent thermal conductivity. For the purpose of supplying the molten metal 1 from the pouring gate 13 to the movable mold (gap between the rolls 14), the supply part 12*d* includes a pump 12*e* between the molten metal reservoir 12 and the pouring gate 13. A pressure of the molten metal 1 supplied from the pouring gate 13 to the gap between the rolls 14 can be regulated, by regulating an output of the pump 12*e*.

In the example shown in FIG. 1, the movable mold is constituted of a pair of rolls 14. The rolls 14 are provided in an opposed relationship with a gap therebetween, and are rendered rotatable by an unillustrated drive mechanism in mutually different directions (clockwise in a roll and counterclockwise in the other). The molten metal 1 is supplied into the gap between the rolls 14, and, under rotation of the rolls 14, the molten metal 1 supplied from the pouring gate 13 solidifies while in contact with the rolls 14, and discharged as a cast material 2. In the present example, as the casting direction is vertically upwards, a molten metal dam 17 (cf. FIGS. 3(A) and 3(B)) is provided in order that the molten metal does not leak downwards from a gap between the movable mold and the pouring gate 13. Each roll 14 incorporates a heating-cooling mechanism (not shown) for arbitrarily regulating the surface temperature, and is equipped with a temperature measuring instrument (not shown) and a temperature controller (not shown).

Then, the present invention is characterized in employing, as a material for forming parts contacted by the molten metal 1 in the process from the melting step to the continuous casting, a low-oxygen material having an oxygen content in a volumic ratio of 20 mass % or less. As such material, the present example employed a cast iron (oxygen concentration: 100 ppm or less in weight proportion) for the crucible 10*a*, a stainless steel (SUS 430, oxygen concentration: 100 ppm or less in weight proportion) for the transfer gutter 11, the molten metal reservoir 12, the supply part 12*d*, the pouring gate 13 and the molten metal dam 17 (cf. FIGS. 3(A) and 3(B), and a copper alloy (composition (mass %): copper 99%, chromium 0.8% and impurities as remainder, oxygen concentration: 100 ppm or less in weight proportion) for the rolls 14.

As the manufacture of the cast material with such continuous casting apparatus allows to reduce a bonding of the molten metal with oxygen, it is possible to reduce a formation of magnesium oxide or a chipping of the oxygen-deprived material, which lead to a deterioration in the surface properties of the cast material. Also as the molten metal is less contaminated by magnesium oxide or an oxygen-deprived material, a deterioration in the secondary working property caused by the presence of these foreign substances can also be reduced.

Particularly in the continuous casting apparatus shown in FIG. 1, the interior of the crucible 10*a* and the interior of the molten metal reservoir 12 may be maintained in a low-oxygen atmosphere by sealing a gas of a low oxygen concentration therein. In such state, the bonding of the molten metal with oxygen can be reduced more effectively. Examples of the gas for constituting the low-oxygen atmosphere include an argon gas with an oxygen content less than 5 vol %, and a mixed gas of carbon dioxide and argon. Also a flame-resisting gas such as $SF_6$ may be mixed.

Figure 2A:
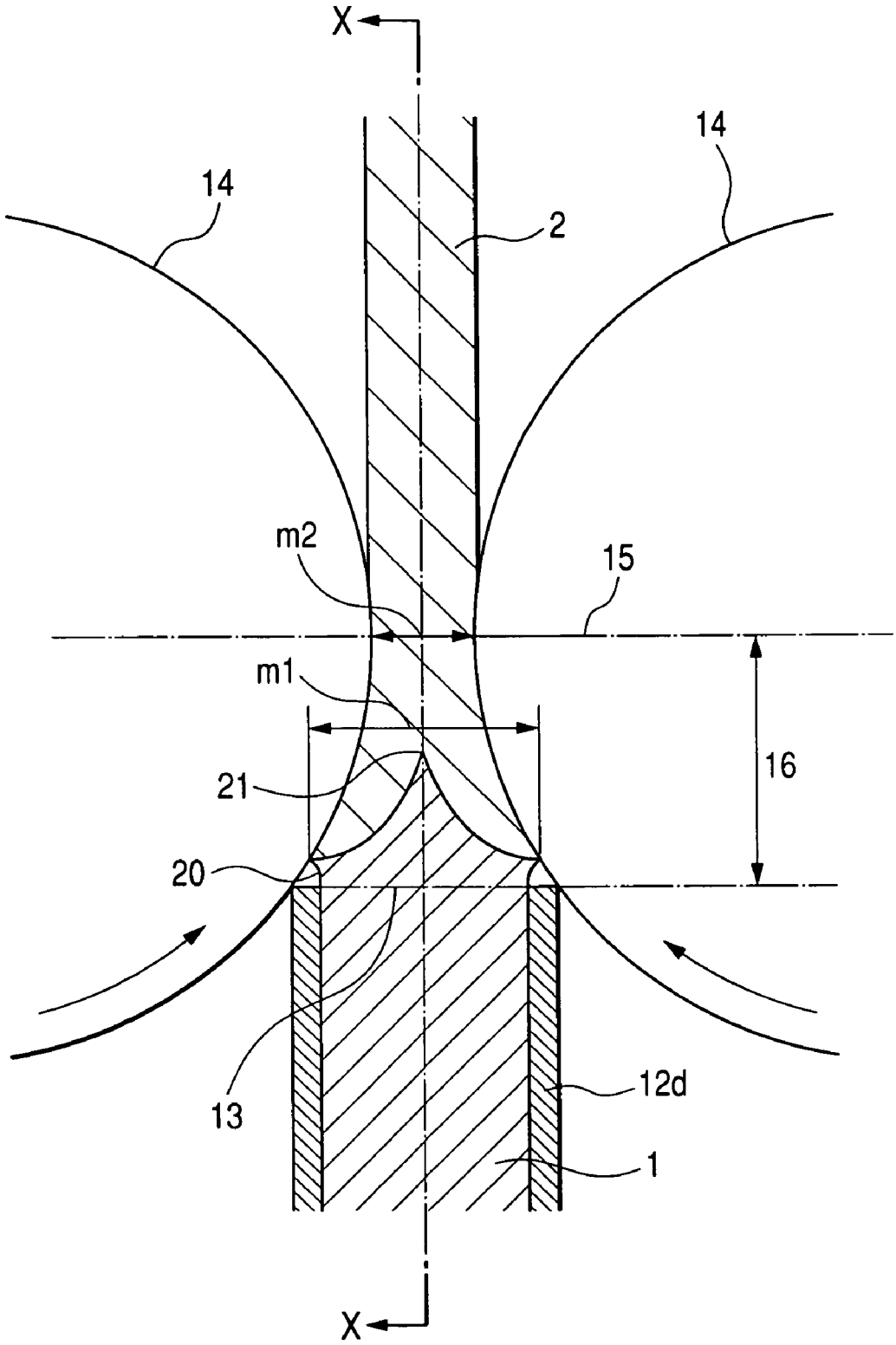
FIG. 2(A) is a partial magnified view showing a structure in the vicinity of a pouring gate, indicating a state where a solidification completion point exists within an offset section.
Figure 2B:
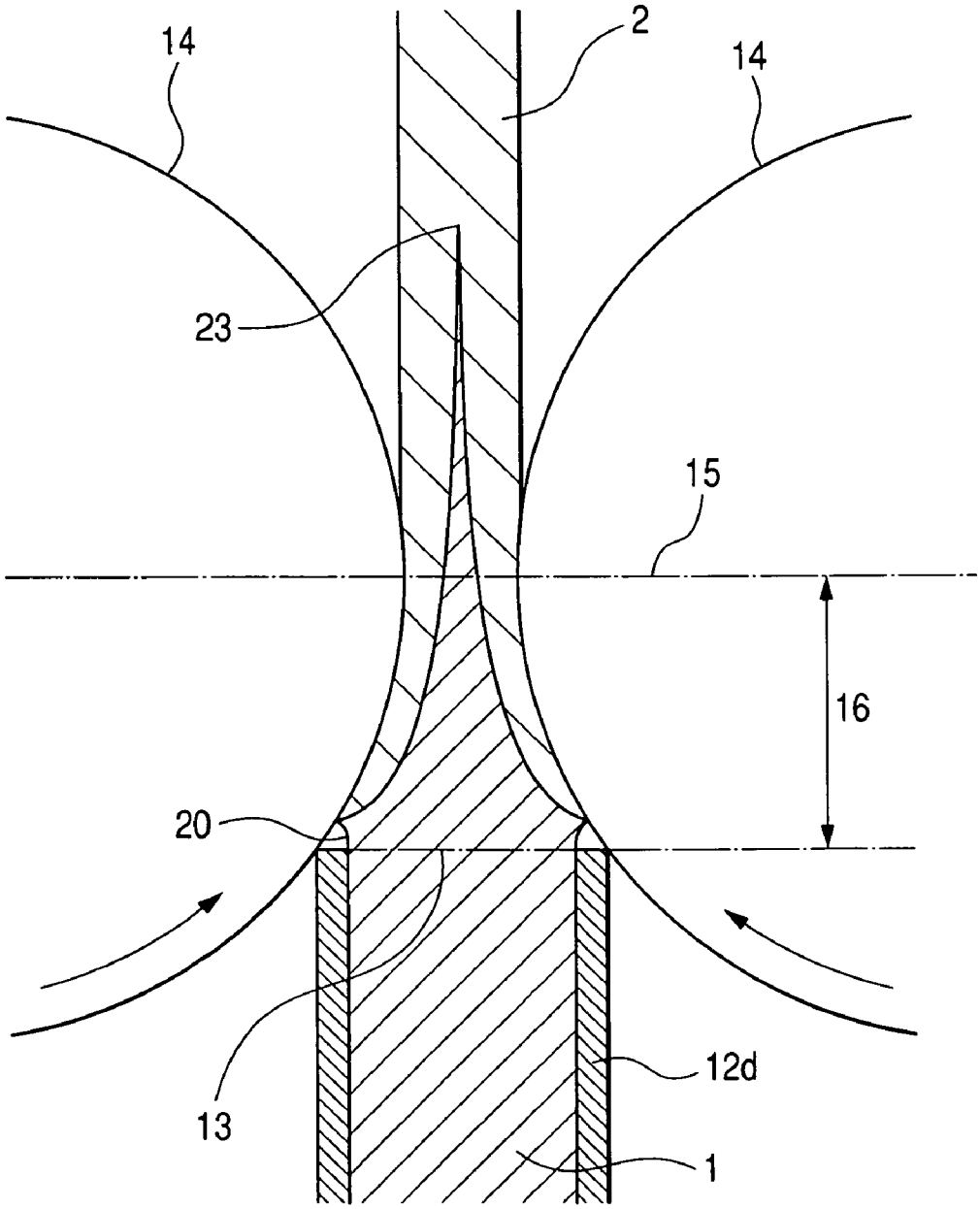
FIG. 2(B) is a partial magnified view showing a structure in the vicinity of a pouring gate, indicating a state where a solidification completion point does not exist within an offset section.

Also in the continuous casting apparatus shown in FIG. 1, a solidification completion point may be positioned within a region to a discharge from the movable mold, by executing such a control as to sufficiently lower the mold temperature and to regulate a driving speed of the movable mold, in consideration of a desired alloy composition and a desired plate thickness and of a material constituting the mold. FIGS. 2(A) and 2(B) are partial magnified views showing a structure in the vicinity of the pouring gate, and FIG. 2(A) indicates a state where the solidification completion point exists within an offset section, while FIG. 2(B) indicates a state where the solidification completion point does not exist within an offset section. A section between a plane including the center axes of the rolls 14 (the plane being hereinafter called a mold center 15) and a distal end of the pouring gate 13 is called an offset 16. As shown in FIG. 2(A), the molten metal 1, supplied from the supply part 12*d*, through the pouring gate 13, to the gap between the rolls 14, is released in a closed space surrounded by the pouring gate 13, the rolls 14 and the unillustrated molten metal dam, and is cooled by contacting the rolls 14 under formation of a meniscus 20 whereby a solidification is initiated. Along the casting direction (upwards in FIGS. 2(A) and 2(B)), the rolls 14 are positioned closer, so that the gap between the rolls 14 becomes smaller. More specifically, when the molten metal 1 supplied from the pouring gate 13 comes into an initial contact with the rolls 14 in an initial stage of the casting, the gap is largest at an initial gap m1 between portions initially contacted by the molten metal 1, and, as the solidified material passes through the mold center 15, the gap becomes a minimum gap m2 where the rolls 14 are positioned closest. Therefore, without generating a gap between a solidified shell formed by a solidification and the rolls 14 by a solidification shrinkage, the solidified shell remains in close contact with the rolls 14 and a cooling effect thereof until the solidification is completed at a solidification completion point 21. Also in a section from the solidification completion point 21 to the mold center 15, the gap between the rolls 14 becomes even smaller. Therefore, the solidified magnesium alloy is subjected to a compressive deformation by a reducing force from the rolls 14, and is discharged from the gap between the rolls 14, thereby providing a cast material 2 with smooth surfaces as in a rolled material. The solidification state is preferably controlled in such a manner that the solidification completion point 21 exists within the section of offset 16. Also a high cooling effect is obtained by selecting the distance of the initial gap m1 as from 1 to 1.55 times of the minimum gap m2.

On the other hand, in a case of not executing a solidification control as described above, the molten metal 1, supplied from the supply part 12*d*, through the pouring gate 13, to the gap between the rolls 14 as shown in FIG. 2(B), is released in a closed space surrounded by the pouring gate 13, the rolls 14 and the unillustrated molten metal dam, and is cooled by contacting the rolls 14 under formation of a meniscus 20 whereby a solidification is initiated. However, it passes through the mold center 15, with a large amount of an unsolidified part in the central part. Thus, a solidification completion point 23 is present in a position after the section of offset 16. Since the magnesium alloy after passing the mold center 15 is separated from the rolls 14, the solidification proceeds not by the cooling by the rolls 14 but by a cooling by heat radiation from the surfaces of the cast material 2. Therefore the solidification rate becomes slower at the central part of the cast material 2, thus causing a center-line segregation.

Figure 3A:
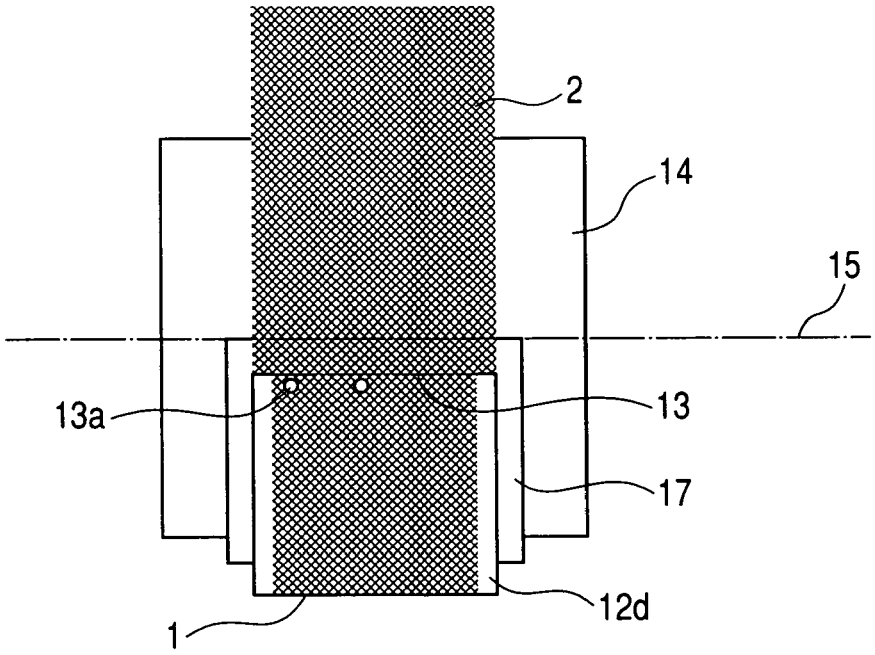
FIG. 3(A) is a cross-sectional view along a line X-X in FIG. 2(A), showing an example in which a pouring gate has a rectangular cross section.
Figure 3B:
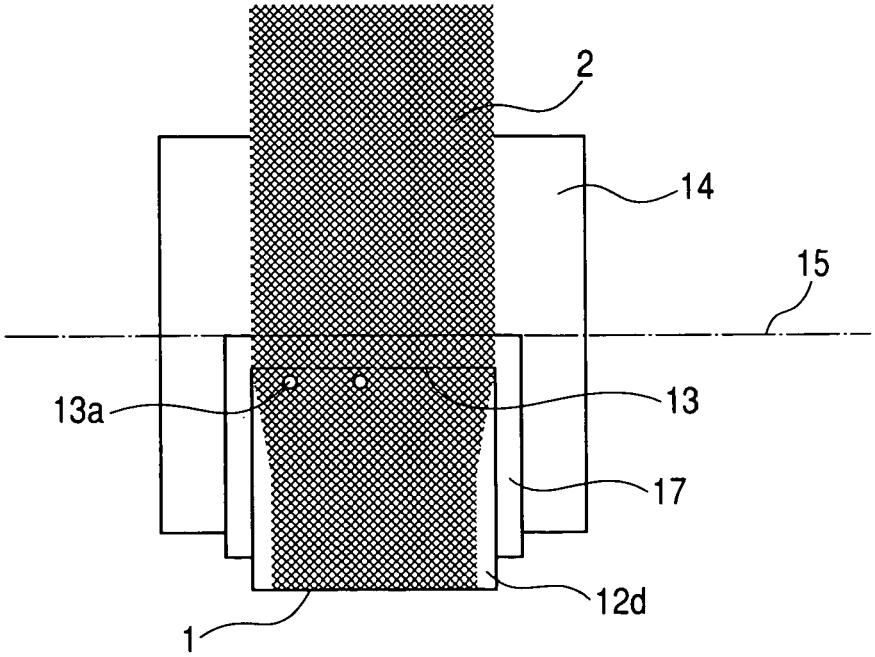
FIG. 3(B) is a cross-sectional view along a line X-X in FIG. 2(A), showing an example in which a pouring gate has a trapezoidal cross section.

FIGS. 3(A) and 3(B) are cross-sectional views along a line X-X in FIG. 2(A), wherein FIG. 3(A) shows an example in which a pouring gate has a rectangular cross section, and FIG. 3(B) shows an example in which a pouring gate has a trapezoidal cross section. Also in the continuous casting apparatus shown in FIG. 1, a region where a meniscus 20 is formed (cf. FIGS. 2(A) and 2(B)) may be made sufficiently small by regulating the pressure of the molten metal 1, supplied from the pouring gate 13 to the gap between the rolls 14, by the pump 12*e*. Also by a control so as to minimize the temperature fluctuation in the molten metal 1 in the transversal cross-sectional direction of the pouring gate 13, the molten metal 1 is immediately filled in the meniscus-forming region thereby providing a satisfactory cast material 2. For example, the temperature measuring device 13*a* as shown in FIG. 3(A) is used to regulate a temperature of separate heating means, such as a heater, in such a manner that a temperature fluctuation in the molten metal 1 in the transversal cross-sectional direction of the pouring gate 13 becomes 10° C. or less, and the pump 12*e* (cf. FIG. 1) is regulated in such a manner that the pressure of the molten metal 1 supplied to the gap between the rolls 14 becomes equal to or larger than 101.8 kPa and less than 118.3 kPa (equal to or larger than 1.005 atm and less than 1.168 atm). In this manner, the molten metal 1 can be sufficiently filled as shown in FIG. 3(A). An example shown in FIG. 3(B) is merely different in the shape of the pouring gate 13, and, as in the example shown in FIG. 3(A), the molten metal 1 can be filled sufficiently by regulating the pressure of the molten metal 1, supplied from the pouring gate 13 to the bag between the rolls 14, by the pump 12*e* (cf. FIG. 1), and by controlling the temperature fluctuation of the molten metal 1 in the transversal cross-sectional direction of the pouring gate 13.

Figure 4A:
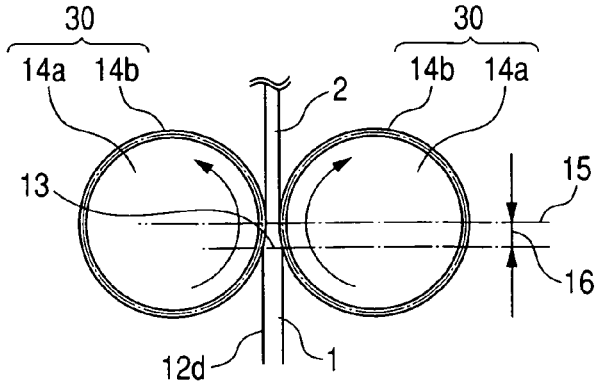
FIG. 4(A) is a partial schematic view of a movable mold, showing an example having a cover layer on a surface of the movable mold, in which the cover layer is contacted with and fixed to the surface of the movable mold.
Figure 4B:
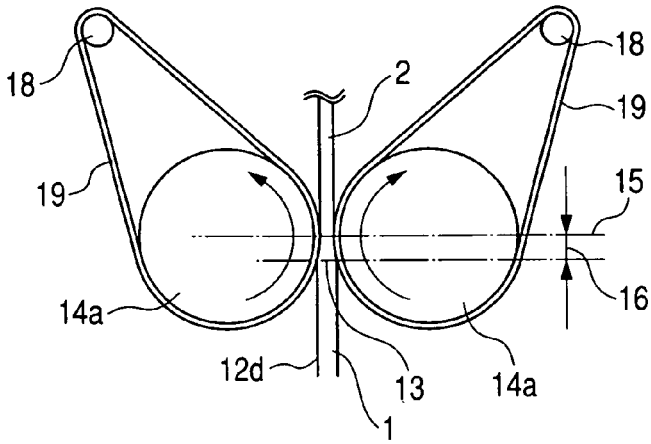
FIG. 4(B) is a partial schematic view of a movable mold, showing an example having a cover layer on a surface of the movable mold, in which the cover layer is movably provided on the surface of the movable mold.

In the continuous casting apparatus shown in FIG. 1, a cover layer may be provided on the movable mold, in order to further increase the cooling rate. FIGS. 4(A) and 4(B) are partial schematic views of a movable mold, showing examples having a cover layer on a surface of the movable mold, wherein FIG. 4(A) shows an example in which the cover layer is contacted with and fixed to the surface of the movable mold, and FIG. 4(B) shows an example, in which the cover layer is movably provided on the surface of the movable mold. A movable mold 30 shown in FIG. 4(A) is provided, on an external periphery of rolls 14*a*, with a cover layer 14*b* of material having a low oxygen content and excellent in thermal conductivity. The cover layer 14*b* is provided in such a manner that the molten metal 1 supplied from the pouring gate 13 and the cast material 2 obtained by solidification do not come into contact with the roll 14*a*. Examples of a material for forming such cover layer 14*b* include copper and a copper alloy. The material for forming the cover layer 14*b* is a material only required to have a low oxygen content and an excellent thermal conductivity as described above, a material that is not strong enough as the material for the rolls 14*a* may also be used. The cover layer 14*b*, having an excellent thermal conductivity, efficiently dissipate the heat of the molten metal 1 when contacted by the molten metal 1, thereby contributing to increase the cooling rate of the molten metal 1. Also because of the excellent thermal conductivity, it also provides an effect of preventing a dimensional change in the roll 14*a* due to a deformation by the heat from the molten metal 1. Also in case the cover layer 14*b* is formed by a material similar to that of the roll 14*a*, the cover layer 14*b* alone may be replaced economically when it is damaged in the operation.

Although the cover layer 14*b* may be contacted with and fixed to the roll 14*a* as described above, as shown in FIG. 4(B), a cover layer 19 may be provided so as to be movable on the external periphery of the roll 14*a*. The cover layer 19 is formed as a belt-shaped member with a material having a low oxygen content and excellent in thermal conductivity as in the cover layer 14*b*, and is constructed in a closed loop structure as shown in FIG. 4(B). Such closed-loop cover layer 19 is supported by a roll 14*a* and a tensioner 18, in such a manner that the cover layer 19 is movable on the external periphery of the roll 14*a*. The cover layer 19, having an excellent thermal conductivity as in the cover layer 14, sufficiently increases the cooling rate of the molten metal 1 and suppresses a dimensional change of the roll 14*a* by a thermal deformation. Also in case the cover layer 19 is formed by a material similar to that of the roll 14*a*, the cover layer 19 alone may be replaced when it is damaged in the operation. Also the cover layer 19, so constructed as to displace between the roll 14*a* and the tensioner 18, it may be subjected to a surface cleaning or a correction of a deformation by a thermal strain, after contacting the molten metal 1 and before a next contact. Also heating means for heating the cover layer 19 may be provided between the roll 14*a* and the tensioner 18.

Figure 5:
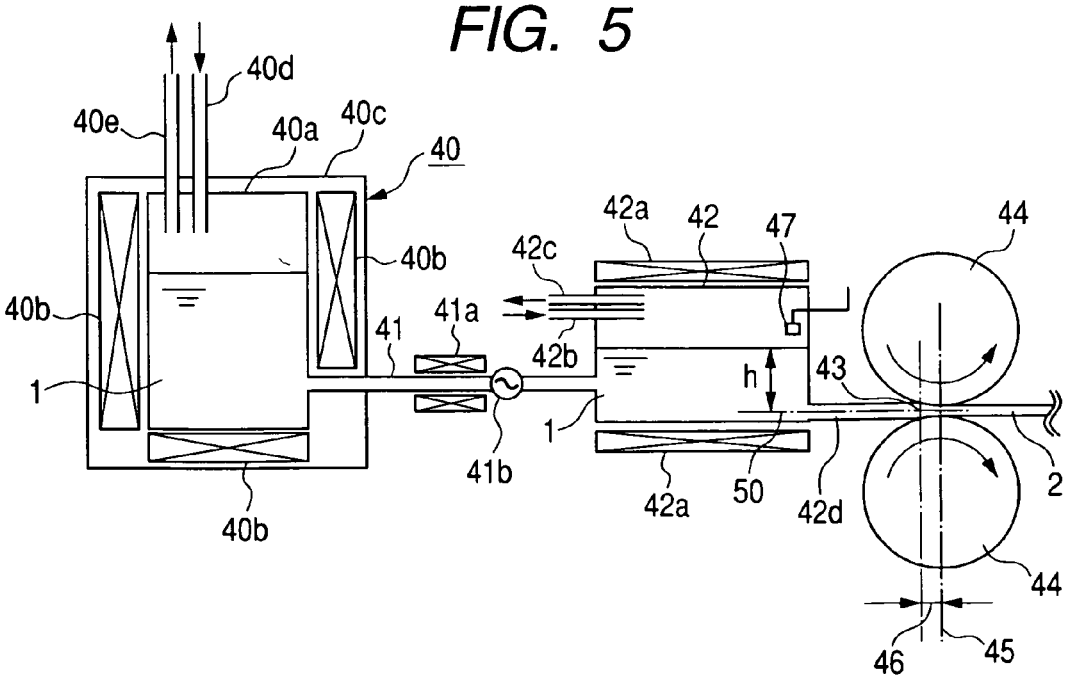
FIG. 5 is a schematic view of a continuous casting apparatus for a magnesium alloy, in which a molten metal is supplied by a weight thereof to a movable mold.

FIG. 5 is a schematic view of a continuous casting apparatus for a magnesium alloy, in which a molten metal is supplied to a movable mold, utilizing the weight of the molten metal. The continuous casting apparatus is similar in a basic structure to the apparatus shown in FIG. 1. More specifically, it is equipped with a melting furnace 40 for melting a magnesium alloy to form a molten metal 1, a molten metal reservoir 42 for temporarily storing the molten metal 1 from the melting furnace 40, a transfer gutter 41 provided between the melting furnace 40 and the molten metal reservoir 42 for transporting the molten metal 1 from the melting furnace 40 to the molten metal reservoir 42, a supply part 42*d* including a pouring gate 43 for supplying the molten metal 1 from the molten metal reservoir 42 to a gap between a pair of rolls 44, and a pair of rolls 44 for casting the supplied molten metal 1 thereby forming a cast material 2. A difference lies in a fact that the molten metal 1 is supplied by the weight thereof to the gap between the rolls 44.

In the apparatus shown in FIG. 5, the melting furnace 40, as in the melting furnace 10 shown in FIG. 1, includes a crucible 40*a*, a heater 40*b*, and a casing 40*c*, a temperature measuring device (not shown) and a temperature controller (not shown). Also the crucible 40*a* is provided with a gas introducing pipe 40*d*, an exhaust pipe 40*e* and a gas controller (not shown). Also the crucible 40*a* is equipped with a fin (not shown) for agitating the molten metal 1 thereby rendered capable of agitation. The transfer gutter 41 is connected, at an end thereof, with the crucible 40*a*, and, at the other end with the molten metal reservoir 42, and is provided in an intermediate part with a heater 41*a* and a valve 41*b* for supplying the molten metal 1 to the molten metal reservoir 42. On an external periphery of the transfer gutter 41, an ultrasonic agitating apparatus (not shown) is provided.

In the example shown in FIG. 5, the molten metal reservoir 42 is equipped, on an external periphery thereof, with a heater 42*a*, a temperature measuring instrument (not shown) and a temperature controller (not shown). Also the molten metal reservoir 42 is provided with a gas introducing pipe 42*b*, an exhaust pipe 42*c* and a gas controller (not shown). Also the molten metal reservoir 42 is equipped with a fin (not shown) for agitating the molten metal 1 thereby rendered capable of agitation. The supply part 42*d* is connected, at an end thereof, with the molten metal reservoir 42, and is provided, at the other end (at a side of the rolls 44 constituting the movable mold), with a pouring gate 43. In the vicinity of the pouring gate 43, a temperature measuring device (not shown) is provided for a temperature management of the molten metal 1 supplied to the pouring gate 43. The temperature measuring device is so positioned as not to hinder the flow of the molten metal 1. In order that the molten metal 1 is supplied from the pouring gate 43 to the gap between the rolls 44 by the weight of the molten metal 1, a center line 50 to be explained later of the gap between the rolls 44 is positioned horizontally, and the molten metal reservoir 42, the pouring gate 43 and rolls 44 are positioned in such a manner that the molten metal is supplied from the molten metal reservoir 42, through the pouring gate 43, in a horizontal direction to the gap between the rolls 44 and that the cast material 2 is formed in a horizontal direction. Also the supply part 42*d* is positioned lower than a liquid level of the molten metal 1 in the molten metal reservoir 42. A sensor 47 for detecting the liquid level is provided, for executing a regulation that the liquid level of the molten metal 1 in the molten metal reservoir 42 comes to a predetermined height h from the center line 50 of the gap between the rolls 44. The sensor 47 is connected to an unillustrated controller, which regulates the valve 41*b* in response to a detection result of the sensor 47 to control the flow rate of the molten metal 1, thereby regulating the pressure of the molten metal 1 in the supply from the pouring gate 43 to the gap between the rolls 44. More specifically, a height of a point distant by 30 mm from the center line 50 is selected as a set value for the liquid level of the molten metal 1, and the liquid level is preferably so controlled to be positioned at such set value ±10%. Also the pressure of the molten metal 1 is desirably made equal to or larger than 101.8 kPa and less than 118.3 kPa (equal to or larger than 1.005 atm and less than 1.168 atm).

In the example shown in FIG. 5, the movable mold is constituted of a pair of rolls 44. The rolls 44 are provided in an opposed relationship with a gap therebetween, and are rendered rotatable by an unillustrated drive mechanism in mutually different directions (clockwise in a roll and counterclockwise in the other). Particularly, the rolls 44 are disposed such that the center line 50 of the gap between the rolls is positioned horizontally. The molten metal 1 is supplied into the gap between the rolls 44, and, under rotation of the rolls 44, the molten metal 1 supplied from the pouring gate 43 solidifies while in contact with the rolls 44, and discharged as a cast material 2. In the present example, the casting direction is horizontal. Each roll 44 incorporates a heating-cooling mechanism (not shown) for arbitrarily regulating the surface temperature, and is equipped with a temperature measuring instrument (not shown) and a temperature controller (not shown).

In the present example, graphite (oxygen concentration: 50 ppm or less in weight proportion (excluding oxygen in pores) is employed as a low-oxygen material having an oxygen content of 20% by mass for forming the crucible 40*a*, the transfer gutter 41, the molten metal reservoir 42, the supply part 42*d* and the pouring gate 43. Also as a material for forming the rolls 44, a copper alloy (composition (mass %):

copper 99%, chromium 0.8% and impurities as remainder, oxygen concentration: 100 ppm or less in weight proportion) is employed.

The manufacture of the cast material with such continuous casting apparatus allows, as in the apparatus shown in FIG. 1, to reduce drawbacks resulting from a bonding of the molten metal with oxygen, namely a deterioration of the surface properties of the cast material and a loss in the secondary working property. Also in the apparatus shown in FIG. 5, a low-oxygen atmosphere is maintained in the interior of the crucible 40*a* and the interior of the molten metal reservoir 42 to effectively reduce the bonding of the molten metal with oxygen.

TEST EXAMPLE 1

Continuous casting is conducted with the continuous casting apparatus shown in FIG. 5 to produce cast materials (plate materials). Characteristics of the obtained cast materials are investigated. Composition, cast conditions and characteristics of the investigated magnesium alloys are shown in Tables 1 to 5. Tables 1-5 show the material of the mold only, and materials for constituents other than the mold are same as those (carbon) shown in FIG. 5. In Table 1 to 5, a maximum temperature, a minimum temperature and a fluctuation of molten metal mean the temperatures at the pouring gate and the fluctuation in the transversal cross-sectional directional direction of the pouring gate. An offset mean a distance (offset 46) between the plane including the central axes of the rolls 44 (hereinafter mold center 45) and the distal end of the pouring gate 43 in FIG. 5. An atmosphere is constituted of oxygen in a content shown in Tables 1 to 5 and a mixed gas of argon and nitrogen in the remainder. A gap at pouring gate means a gap between parts of rolls initially contacted by the molten metal supplied from the pouring gate. A roll gap at the mold center means a minimum gap where the rolls are positioned closest. A reduction rate is defined by (gap at pouring gate/minimum gap)×100. A supply pressure means a compression load applied from the molten metal (including solidified portion) to the rolls. A temperature of cast material means a surface temperature of the magnesium alloy material immediately after discharge from the rolls. A fluctuation in components is determined based on set contents corresponding to the composition of each sample shown in Tables 1 to 5.

TABLE 1

| | | sample No., composition (mass %) | | | |
|---|---|---|---|---|---|
| item | unit | No. 1<br>Mg<br>3 mass % Al<br>1 mass % Zn<br>0.03 mass % Ca | No. 2<br>Mg<br>3 mass % Al<br>1 mass % Zn | No. 3<br>Mg<br>3 mass % Al<br>1 mass % Zn<br>0.05 mass % Ca | No. 4<br>Mg<br>6 mass % Al<br>1 mass % Zn<br>0.03 mass % Ca |
| Casting conditions | | | | | |
| melting point | (° C.) | 630 | 630 | 630 | 610 |
| conductivity x | (% IACS) | 18 | 18 | 18 | 12 |
| oxygen content in atmosphere | (vol %) | 4 | 4 | 4 | 4 |
| molten metal liquid level from roll gap center line | (mm) | 50 | 50 | 50 | 50 |
| converted supply pressure (molten metal pressure) | (kPa) | 102.1 | 102.1 | 102.1 | 102.1 |
| molten metal max temperature | (° C.) | 705 | 700 | 700 | 695 |
| molten metal min temperature | (° C.) | 700 | 695 | 695 | 690 |
| molten metal temperature fluctuation | (° C.) | 5 | 5 | 5 | 5 |
| movable mold (roll) diameter | (mm) | 400 | 400 | 400 | 400 |
| offset | (mm) | 15 | 15 | 15 | 15 |
| ratio of offset/roll circumferential length | (%) | 1.2 | 1.2 | 1.2 | 1.2 |
| gap at pouring gate | (mm) | 4.6 | 5.1 | 5.1 | 4.6 |
| roll gap at mold center | (mm) | 3.5 | 4 | 4 | 3.5 |
| reduction rate | (times) | 1.31 | 1.28 | 1.28 | 1.31 |
| solidification completion point/offset | (%) | 40 | 38 | 38 | 40 |
| cooling rate | (K/sec) | 636 | 783 | 523 | 2129 |
| roll load | (N) | 670000 | 630000 | 630000 | 650000 |
| plate width | (mm) | 200 | 200 | 200 | 200 |
| load per plate width | (N/mm) | 3350 | 3150 | 3150 | 3250 |
| cast plate temperature | (° C.) | 270 | 270 | 300 | 250 |
| mold material | | copper alloy | copper alloy | copper | copper |
| electroconductivity y of mold material | (% IACS) | 80 | 80 | 10 | 100 |
| melting point of mold material | (K) | 1256 | 1256 | 1766 | 1356 |
| relation 100 ≧ y > x − 10 | (○/X) | ○ | ○ | ○ | ○ |
| cover layer | | none | none | none | none |
| electroconductivity y' of cover layer | (% IACS) | — | — | — | — |
| thickness of cover layer | (μm) | — | — | — | — |
| melting point of cover layer | (K) | — | — | — | — |
| relation 100 ≧ y' > x − 10 | (○/X) | — | — | — | — |
| melting point of surface material of movable mold | (K) | 1256 | 1256 | 1766 | 1356 |
| surface temperature of movable mold | (K) | 423 | 423 | 423 | 423 |
| relation (movable mold surface temp./surface mat. m.p.) | (○/X) | 34%: ○ | 34%: ○ | 24%: ○ | 31%: ○ |
| Cast material characteristics | | | | | |
| thickness | (mm) | 4.3 | 4.8 | 4.8 | 4.3 |
| DAS | (μm) | 4.8 | 4.5 | 5.1 | 3.3 |
| max size of intermetallic compounds | (μm) | <1 | <1 | <1 | 4.0 |
| component element contained at least by 0.5% | | Al, Zn | Al, Zn | Al, Zn | Al, Zn |
| fluctuation element/min.-max. | (mass %) | Al/2.70-2.78 | Al/2.70-2.78 | Al/2.70-2.78 | Al/5.95-6.07 |
| element/compositional average | (%) | Al/2.7% | Al/2.7% | Al/2.7% | Al/2.0% |

TABLE 1-continued

| item | | unit | sample No., composition (mass %) | | | |
|---|---|---|---|---|---|---|
| | | | No. 1<br>Mg<br>3 mass % Al<br>1 mass % Zn<br>0.03 mass % Ca | No. 2<br>Mg<br>3 mass % Al<br>1 mass % Zn | No. 3<br>Mg<br>3 mass % Al<br>1 mass % Zn<br>0.05 mass % Ca | No. 4<br>Mg<br>6 mass % Al<br>1 mass % Zn<br>0.03 mass % Ca |
| | element/min.-max. | (mass %) | Zn/0.81-0.89 | Zn/0.81-0.89 | Zn/0.81-0.89 | Zn/0.81-0.89 |
| | element/compositional average | (%) | Zn/8.0% | Zn/8.0% | Zn/8.0% | Zn/8.0% |
| | relation: fluctuation ≦ 10% | (○/X) | ○ | ○ | ○ | ○ |
| surface defect depth | | (mm) | 0.06 | 0.05 | 0.06 | 0.06 |
| surface defect depth/plate thickness | | (%) | 1.3% | 1.1% | 1.2% | 1.5% |
| ripple mark max width rw | | (mm) | 0.5 mm | mm | 0.5 mm | 0.6 mm |
| ripple mark max depth rd | | (mm) | 0.01 mm | 0.01 mm | 0.01 mm | 0.01 mm |
| relation: rw × rd | | (○/X) | 0.005: ○ | 0.005: ○ | 0.005: ○ | 0.006: ○ |
| tensile strength | | (MPa) | 213 | 215 | 208 | 215 |
| breaking elongation | | (%) | 3.5 | 3.2 | 3.6 | 2.5 |

TABLE 2

| item | | unit | sample No., composition (mass %) | | | |
|---|---|---|---|---|---|---|
| | | | No. 5<br>Mg<br>8 mass % Al<br>0.6 mass % Zn<br>0.03 mass % Ca | No. 6<br>Mg<br>9 mass % Al<br>1 mass % Zn<br>0.03 mass % Ca | No. 7<br>Mg<br>4 mass % Al<br>1 mass % Si | No. 8<br>Mg<br>2.5 mass % Zn<br>7 mass % Y |
| Casting conditions | | | | | | |
| melting point | | (° C.) | 610 | 595 | 617 | 600 |
| conductivity x | | (% IACS) | 11 | 10 | 12 | 10 |
| oxygen content in atmosphere | | (%) | 4 | 4 | 4 | 4 |
| molten metal liquid level from roll gap center line | | (mm) | 75 | 75 | 75 | 75 |
| converted supply pressure (molten metal pressure) | | (kPa) | 102.6 | 102.6 | 102.6 | 102.6 |
| molten metal max temperature | | (° C.) | 670 | 680 | 700 | 685 |
| molten metal min temperature | | (° C.) | 662 | 671 | 695 | 680 |
| molten metal temperature fluctuation | | (° C.) | 8 | 9 | 5 | 5 |
| movable mold (roll) diameter | | (mm) | 400 | 400 | 400 | 400 |
| offset | | (mm) | 15 | 15 | 20 | 17 |
| ratio of offset/roll circumferential length | | (%) | 1.2 | 1.2 | 1.6 | 1.4 |
| gap at pouring gate | | (mm) | 4.1 | 5.1 | 6.0 | 5.5 |
| roll gap at mold center | | (mm) | 3 | 4 | 4 | 4 |
| reduction rate | | (times) | 1.37 | 1.28 | 1.50 | 1.38 |
| solidification completion point/offset | | (%) | 40 | 25 | 40 | 30 |
| cooling rate | | (K/sec) | 523 | 557 | 1933 | 2895 |
| roll load | | (N) | 700000 | 630000 | 430000 | 350000 |
| plate width | | (mm) | 200 | 200 | 130 | 130 |
| load per plate width | | (N/mm) | 3500 | 3150 | 3310 | 2690 |
| cast plate temperature | | (° C.) | 270 | 270 | 250 | 250 |
| mold material | | | copper | copper | copper | Copper |
| electroconductivity y of mold material | | (% IACS) | 10 | 10 | 100 | 100 |
| melting point of mold material | | (K) | 1766 | 1766 | 1356 | 1356 |
| relation 100 ≧ y > x − 10 | | (○/X) | ○ | ○ | ○ | ○ |
| cover layer | | | copper alloy | copper alloy | Mg | none |
| electroconductivity y' of cover layer | | (% IACS) | 20 | 25 | 38 | — |
| thickness of cover layer | | (μm) | 20 | 50 | 50 | — |
| melting point of cover layer | | (K) | 1173 | 1173 | 923 | — |
| relation 100 ≧ y' > x − 10 | | (○/X) | ○ | ○ | ○ | — |
| melting point of surface material of movable mold | | (K) | 1173 | 1173 | 923 | 1356 |
| surface temperature of movable mold | | (K) | 423 | 423 | 423 | 353 |
| relation (movable mold surface temp./surface mat. m.p.) | | (○/X) | 36%: ○ | 36%: ○ | 46%: ○ | 26%: ○ |
| Cast material characteristics | | | | | | |
| thickness | | (mm) | 3.9 | 4.8 | 4.5 | 4.4 |
| DAS | | (μm) | 5.1 | 5 | 3.4 | 3 |
| max size of intermetallic compounds | | (μm) | 5.0 | 5.0 | 15.0 | 6.7 |
| component | element contained at least by 0.5% | | Al, Zn | Al, Zn | Al, Si | Zn, Y |
| fluctuation | element/min.-max. | (mass %) | Al/8.00-8.15 | Al/8.82-9.08 | Al/4.10-4.21 | Zn/2.35-2.51 |
| | element/compositional average | (%) | Al/1.9% | Al/2.9% | Al/2.8% | Zn/6.4% |
| | element/min.-max. | (mass %) | Zn/0.62-0.65 | Zn/0.81-0.89 | Si/1.05-1.08 | Y/6.51-6.73 |
| | element/compositional average | (%) | Zn/5.0% | Zn/8.0% | Si/3.0% | Y/3.1% |
| | relation: fluctuation ≦ 10% | (○/X) | ○ | ○ | ○ | ○ |
| surface defect depth | | (mm) | 0.06 | 0.08 | 0.16 | 0.19 |
| surface defect depth/plate thickness | | (%) | 1.6% | 1.6% | 3.5% | 4.3% |

TABLE 2-continued

| item | unit | sample No., composition (mass %) | | | |
|---|---|---|---|---|---|
| | | No. 5<br>Mg<br>8 mass % Al<br>0.6 mass % Zn<br>0.03 mass % Ca | No. 6<br>Mg<br>9 mass % Al<br>1 mass % Zn<br>0.03 mass % Ca | No. 7<br>Mg<br>4 mass % Al<br>1 mass % Si | No. 8<br>Mg<br>2.5 mass % Zn<br>7 mass % Y |
| ripple mark max width rw | (mm) | 0.3 mm | 0.5 mm | 1.0 mm | 0.2 mm |
| ripple mark max depth rd | (mm) | 0.01 mm | 0.01 mm | 0.01 mm | 0.01 mm |
| relation: rw × rd | (○/X) | 0.003: ○ | 0.005: ○ | 0.010: ○ | 0.002: ○ |
| tensile strength | (MPa) | 230 | 241 | 205 | 260 |
| breaking elongation | (%) | 1.2 | 1.1 | 1.1 | 1.1 |

TABLE 3

| item | unit | sample No., composition (mass %) | | | |
|---|---|---|---|---|---|
| | | No. 9<br>Mg<br>3 mass % Al<br>1 mass % Zn<br>0.03 mass % Ca | No. 10<br>Mg<br>0.03 mass % Ca | No. 11<br>Mg<br>3 mass % Al<br>1 mass % Zn<br>0.03 mass % Ca | No. 12<br>Mg<br>3 mass % Al<br>1 mass % Zn<br>0.03 mass % Ca |
| Casting conditions | | | | | |
| melting point | (° C.) | 630 | 650 | 630 | 630 |
| conductivity x | (% IACS) | 18 | 38 | 18 | 18 |
| oxygen content in atmosphere | (%) | 4 | 4 | 15 | 4 |
| molten metal liquid level from roll gap center line | (mm) | 155 | 155 | 155 | 155 |
| converted supply pressure (molten metal pressure) | (kPa) | 104.0 | 104.0 | 104.0 | 104.0 |
| molten metal max temperature | (° C.) | 705 | 700 | 705 | 697 |
| molten metal min temperature | (° C.) | 700 | 695 | 700 | 697 |
| molten metal temperature fluctuation | (° C.) | 5 | 5 | 5 | 3 |
| movable mold (roll) diameter | (mm) | 400 | 400 | 400 | 400 |
| offset | (mm) | 15 | 10 | 18 | 15 |
| ratio of offset/roll circumferential length | (%) | 1.2 | 0.8 | 1.4 | 1.2 |
| gap at pouring gate | (mm) | 4.1 | 1.6 | 4.6 | 4.6 |
| roll gap at mold center | (mm) | 3 | 1 | 3 | 3.5 |
| reduction rate | (times) | 1.37 | 1.55 | 1.53 | 1.31 |
| solidification completion point/offset | (%) | 30 | 35 | 30 | 30 |
| cooling rate | (K/sec) | 595 | 3617 | 1472 | 2604 |
| roll load | (N) | 360000 | 300000 | 1600000 | 250000 |
| plate width | (mm) | 130 | 80 | 500 | 80 |
| load per plate width | (N/mm) | 2770 | 3750 | 3200 | 3130 |
| cast plate temperature | (° C.) | 300 | 250 | 250 | 250 |
| mold material | | copper | copper | copper | copper |
| electroconductivity y of mold material | (% IACS) | 10 | 100 | 100 | 100 |
| melting point of mold material | (K) | 1766 | 1356 | 1356 | 1356 |
| relation 100 ≧ y > x − 10 | (○/X) | ○ | ○ | ○ | ○ |
| cover layer | | copper alloy | none | none | none |
| electroconductivity y' of cover layer | (% IACS) | 25 | — | — | — |
| thickness of cover layer | (μm) | 50 | — | — | — |
| melting point of cover layer | (K) | 1173 | — | — | — |
| relation 100 ≧ y' > x − 10 | (○/X) | ○ | — | — | — |
| melting point of surface material of movable mold | (K) | 1173 | 1356 | 1356 | 1356 |
| surface temperature of movable mold | (K) | 353 | 423 | 423 | 423 |
| relation (movable mold surface temp./surface mat. m.p.) | (○/X) | 30%: ○ | 31%: ○ | 31%: ○ | 31%: ○ |
| Cast material characteristics | | | | | |
| thickness | (mm) | 3.5 | 1.4 | 5.0 | 3.8 |
| DAS | (μm) | 4.9 | 2.8 | 3.7 | 3.1 |
| max size of intermetallic compounds | (μm) | 20.0 | <1 | <1 | <1 |
| component element contained at least by 0.5% | | Al, Zn | — | Al, Zn | Al, Zn |
| fluctuation element/min.-max. | (mass %) | Al/2.70-2.78 | — | Al/2.70-2.78 | Al/2.70-2.78 |
| element/compositional average | (%) | Al/2.7% | — | Al/2.7% | Al/2.7% |
| element/min.-max. | (mass %) | Zn/0.81-0.89 | — | Zn/0.81-0.89 | Zn/0.81-0.89 |
| element/compositional average | (%) | Zn/8.0% | — | Zn/8.0% | Zn/8.0% |
| relation: fluctuation ≦ 10% | (○/X) | ○ | ○ | ○ | ○ |
| surface defect depth | (mm) | 0.04 | 0.00 | 0.06 | 0.05 |
| surface defect depth/plate thickness | (%) | 1.2% | 0.1% | 1.2% | 1.4% |
| ripple mark max width rw | (mm) | 0.5 mm | 0.2 mm | 0.5 mm | 0.5 mm |
| ripple mark max depth rd | (mm) | 0.01 mm | 0.01 mm | 0.01 mm | 0.01 mm |
| relation: rw × rd | (○/X) | 0.005: ○ | 0.002: ○ | 0.005: ○ | 0.005: ○ |
| tensile strength | (MPa) | 220 | 195 | 215 | 213 |
| breaking elongation | (%) | 3.6 | 2.8 | 3.4 | 3.6 |

TABLE 4

| item | unit | sample No., composition (mass %) | | | |
|---|---|---|---|---|---|
| | | No. 13 Mg 4 mass % Al 2 mass % Si | No. 14 Mg 4 mass % Al 5 mass % Si | No. 15 Mg 9 mass % Al 2 mass % Si | No. 16 Mg 6 mass % Zn 0.4 mass % Zr |
| Casting conditions | | | | | |
| melting point | (° C.) | 630 | 680 | 595 | 635 |
| conductivity x | (% IACS) | 11 | 10 | 10 | 10 |
| oxygen content in atmosphere | (%) | 4 | 4 | 4 | 15 |
| molten metal liquid level from roll gap center line | (mm) | 155 | 155 | 75 | 75 |
| converted supply pressure (molten metal pressure) | (kPa) | 104.0 | 104.0 | 102.6 | 102.6 |
| molten metal max temperature | (° C.) | 710 | 730 | 680 | 690 |
| molten metal min temperature | (° C.) | 680 | 700 | 671 | 665 |
| molten metal temperature fluctuation | (° C.) | 5 | 5 | 9 | 5 |
| movable mold (roll) diameter | (mm) | 400 | 400 | 400 | 400 |
| offset | (mm) | 15 | 15 | 15 | 15 |
| ratio of offset/roll circumferential length | (%) | 1.2 | 1.2 | 1.2 | 1.2 |
| gap at pouring gate | (mm) | 4.1 | 4.1 | 5.1 | 4.1 |
| roll gap at mold center | (mm) | 3 | 3 | 4 | 3 |
| reduction rate | (times) | 1.37 | 1.37 | 1.28 | 1.37 |
| solidification completion point/offset | (%) | 30 | 30 | 25 | 30 |
| cooling rate | (K/sec) | 636 | 636 | 783 | 636 |
| roll load | (N) | 460000 | 460000 | 730000 | 560000 |
| plate width | (mm) | 130 | 130 | 200 | 150 |
| load per plate width | (N/mm) | 3540 | 3540 | 3650 | 3730 |
| cast plate temperature | (° C.) | 300 | 300 | 300 | 300 |
| mold material | | copper | copper | copper | copper |
| electroconductivity y of mold material | (% IACS) | 100 | 100 | 100 | 100 |
| melting point of mold material | (K) | 1356 | 1356 | 1356 | 1356 |
| relation 100 ≧ y > x − 10 | (○/X) | ○ | ○ | ○ | ○ |
| cover layer | | none | none | none | none |
| electroconductivity y' of cover layer | (% IACS) | — | — | — | — |
| thickness of cover layer | (μm) | — | — | — | — |
| melting point of cover layer | (K) | — | — | — | — |
| relation 100 ≧ y' > x − 10 | (○/X) | — | — | — | — |
| melting point of surface material of movable mold | (K) | 1356 | 1356 | 1356 | 1356 |
| surface temperature of movable mold | (K) | 423 | 423 | 423 | 423 |
| relation (movable mold surface temp./surface mat. m.p.) | (○/X) | 31%: ○ | 31%: ○ | 31%: ○ | 31%: ○ |
| Cast material characteristics | | | | | |
| thickness | (mm) | 3.5 | 3.5 | 4.8 | 3.5 |
| DAS | (μm) | 4.8 | 4.8 | 4.5 | 4.8 |
| max size of intermetallic compounds | (μm) | 0.9 | 0.9 | 3 | 1.2 |
| component element contained at least by 0.5% | | Al, Si | Al, Si | Al, Si | Zn |
| fluctuation element/min.-max. | (mass %) | Al/3.99-4.11 | Al/3.99-4.11 | Al/8.79-9.06 | Zn/5.70-5.78 |
| element/compositional average | (%) | Al/2.8% | Al/2.8% | Al/3.0% | Zn/1.3% |
| element/min.-max. | (mass %) | Si/1.83-1.95 | Si/4.83-4.95 | Si/1.83-1.95 | — |
| element/compositional average | (%) | Si/6.0% | Si/2.4% | Si/6.0% | — |
| relation: fluctuation ≦ 10% | (○/X) | ○ | ○ | ○ | ○ |
| surface defect depth | (mm) | 0.02 | 0.02 | 0.07 | 0.12 |
| surface defect depth/plate thickness | (%) | 0.6% | 0.6% | 1.5% | 3.4% |
| ripple mark max width rw | (mm) | 0.5 mm | 0.5 mm | 0.5 mm | 0.5 mm |
| ripple mark max depth rd | (mm) | 0.01 mm | 0.01 mm | 0.01 mm | 0.01 mm |
| relation: rw × rd | (○/X) | 0.005: ○ | 0.005: ○ | 0.005: ○ | 0.005: ○ |
| tensile strength | (MPa) | 260 | 290 | 287 | 269 |
| breaking elongation | (%) | 3.6 | 1.6 | 2.4 | 2.1 |

TABLE 5

| item | unit | sample No., composition (mass %) | | | |
|---|---|---|---|---|---|
| | | No. 17 Mg 9 mass % Al 1.5 mass % Ca | No. 18 Mg 5 mass % Al 3 mass % Ca | No. 19 Mg 5 mass % Al 10 mass % Ca | No. 20 Mg 4 mass % Al 2 mass % Si 0.8 mass % Ca |
| Casting conditions | | | | | |
| melting point | (° C.) | 590 | 600 | 610 | 610 |
| conductivity x | (% IACS) | 11 | 10 | 10 | 11 |
| oxygen content in atmosphere | (%) | 4 | 4 | 15 | 4 |
| molten metal liquid level from roll gap center line | (mm) | 75 | 75 | 75 | 155 |

TABLE 5-continued

| item | unit | sample No., composition (mass %) | | | |
|---|---|---|---|---|---|
| | | No. 17<br>Mg<br>9 mass % Al<br>1.5 mass % Ca | No. 18<br>Mg<br>5 mass % Al<br>3 mass % Ca | No. 19<br>Mg<br>5 mass % Al<br>10 mass % Ca | No. 20<br>Mg<br>4 mass % Al<br>2 mass % Si<br>0.8 mass % Ca |
| converted supply pressure (molten metal pressure) | (kPa) | 102.6 | 102.6 | 102.6 | 104.0 |
| molten metal max temperature | (° C.) | 690 | 680 | 700 | 710 |
| molten metal min temperature | (° C.) | 670 | 677 | 680 | 680 |
| molten metal temperature fluctuation | (° C.) | 5 | 5 | 5 | 5 |
| movable mold (roll) diameter | (mm) | 400 | 400 | 400 | 400 |
| offset | (mm) | 15 | 15 | 15 | 15 |
| ratio of offset/roll circumferential length | (%) | 1.2 | 1.2 | 1.2 | 1.2 |
| gap at pouring gate | (mm) | 4.1 | 4.1 | 4.1 | 4.1 |
| roll gap at mold center | (mm) | 3 | 3 | 3 | 3 |
| reduction rate | (times) | 1.37 | 1.37 | 1.37 | 1.37 |
| solidification completion point/offset | (%) | 30 | 30 | 30 | 30 |
| cooling rate | (K/sec) | 783 | 783 | 636 | 636 |
| roll load | (N) | 560000 | 780000 | 780000 | 460000 |
| plate width | (mm) | 150 | 250 | 250 | 130 |
| load per plate width | (N/mm) | 3730 | 3120 | 3120 | 3540 |
| cast plate temperature | (° C.) | 300 | 300 | 300 | 300 |
| mold material | | copper | copper | copper | copper |
| electroconductivity y of mold material | (% IACS) | 100 | 100 | 100 | 100 |
| melting point of mold material | (K) | 1356 | 1356 | 1356 | 1356 |
| relation 100 ≧ y > x − 10 | (○/X) | ○ | ○ | ○ | ○ |
| cover layer | | none | none | none | none |
| electroconductivity y' of cover layer | (% IACS) | — | — | — | — |
| thickness of cover layer | (μm) | — | — | — | — |
| melting point of cover layer | (K) | — | — | — | — |
| relation 100 ≧ y' > x − 10 | (○/X) | — | — | — | — |
| melting point of surface material of movable mold | (K) | 1356 | 1356 | 1356 | 1356 |
| surface temperature of movable mold | (K) | 423 | 423 | 423 | 423 |
| relation (movable mold surface temp./surface mat. m.p.) | (○/X) | 31%: ○ | 31%: ○ | 31%: ○ | 31%: ○ |
| Cast material characteristics | | | | | |
| thickness | (mm) | 3.5 | 3.5 | 3.5 | 3.5 |
| DAS | (μm) | 4.5 | 4.5 | 4.8 | 4.8 |
| max size of intermetallic compounds | (μm) | 0.9 | 1.2 | 2.1 | 0.9 |
| component element contained at least by 0.5% | | Al, Ca | Al, Ca | Al, Ca | Al, Si |
| fluctuation element/min.-max. | (mass %) | Al/8.70-8.78 | Al/4.70-4.78 | Al/4.70-4.78 | Al/3.99-4.11 |
| element/compositional average | (%) | Al/0.9% | Al/1.6% | Al/1.6% | Al/2.8% |
| element/min.-max. | (mass %) | Ca/1.43-1.51 | Ca/2.99-3.05 | Ca/9.81-9.89 | Si/1.83-1.95 |
| element/compositional average | (%) | Ca/5.3% | Ca/2.0% | Ca/0.8% | Si/6.0% |
| relation: fluctuation ≦ 10% | (○/X) | ○ | ○ | ○ | ○ |
| surface defect depth | (mm) | 0.01 | 0.02 | 0.07 | 0.02 |
| surface defect depth/plate thickness | (%) | 0.3% | 0.6% | 1.5% | 0.6% |
| ripple mark max width rw | (mm) | 0.5 mm | 0.5 mm | 0.5 mm | 0.5 mm |
| ripple mark max depth rd | (mm) | 0.01 mm | 0.01 mm | 0.01 mm | 0.01 mm |
| relation: rw × rd | (○/X) | 0.005: ○ | 0.005: ○ | 0.005: ○ | 0.005: ○ |
| tensile strength | (MPa) | 265 | 275 | 265 | 245 |
| breaking elongation | (%) | 1.7 | 1.1 | 0.5 | 3.6 |

As a result, the casting could be executed without causing a cracking or the like, and the obtained cast materials are found, as shown in Tables 1 to 5, to have a uniform composition, an excellent surface quality, fine intermetallic compounds and excellent mechanical characteristics.

TEST EXAMPLE 2

Thus obtained cast materials are subjected to a rolling work to prepare rolled materials. Each rolled material is subjected, after the rolling work, to a heat treatment (for about 1 hour, at a temperature suitably selected according to the composition, within a temperature range of from 100 to 350° C.). The rolled materials obtained after the heat treatment are investigated for characteristics. Rolling conditions and characteristics are shown in Tables 6 to 10. The rolling work is conducted by plural passes, with a one-pass reduction rate within a range of from 1 to 50% and at a temperature of from 150 to 350° C., and a rolling is conducted in a final pass under conditions shown in Tables to 10. A commercial rolling oil is employed as a lubricating agent.

TABLE 6

| item | unit | sample No., composition (mass %) | | | |
|---|---|---|---|---|---|
| | | No. 1<br>Mg<br>3 mass % Al<br>1 mass % Zn<br>0.03 mass % Ca | No. 2<br>Mg<br>3 mass % Al<br>1 mass % Zn | No. 3<br>Mg<br>3 mass % Al<br>1 mass % Zn<br>0.05 mass % Ca | No. 4<br>Mg<br>6 mass % Al<br>1 mass % Zn<br>0.03 mass % ca |
| Rolling conditions | | | | | |
| plate thickness before rolling | (mm) | 4.3 | 4.8 | 4.8 | 4.3 |
| total reduction rate | (%) | 88% | 92% | 92% | 88% |
| max value of 1-pass reduction rate c | (%) | 25 | 25 | 25 | 15 |
| min value of 1-pass reduction rate c | (%) | 9 | 9 | 9 | 6 |
| step meeting relation 50 ≧ c ≧ 1 present? | (○/X) | ○ | ○ | ○ | ○ |
| surface temp of rolling rolls in last pass | (° C.) | 175 | 175 | 175 | 175 |
| material temp. t1 before rolling in last pass | (° C.) | 20 | 20 | 20 | 20 |
| material temp. t2 after rolling in last pass | (° C.) | 165 | 165 | 165 | 165 |
| T | (° C.) | 165 | 165 | 165 | 165 |
| reduction rate c in last pass | (%) | 9 | 9 | 9 | 6 |
| relation T/c | (○/X) | 18.3 | 18.3 | 18.3 | 27.5 |
| Rolled material characteristics | | | | | |
| thickness | (mm) | 0.5 | 0.4 | 0.4 | 0.5 |
| average crystal grain size | (μm) | 3.3 | 3.3325 | 3.57 | 3.36 |
| average crystal grain size in surface part | (μm) | 3 | 3.1 | 3.4 | 3.2 |
| average crystal grain size in central part | (μm) | 3.6 | 3.565 | 3.74 | 3.52 |
| difference in average crystal grain size between surface and central parts | (μm) | 0.6 | 0.465 | 0.34 | 0.32 |
| relation (difference in average crystal grain size between surface and central parts ≦ 20%) | (%) | 18.2%: ○ | 14.0%: ○ | 9.5%: ○ | 9.5%: ○ |
| max size of intermetallic compounds | (μm) | none | none | none | 4 |
| component element contained at least by 0.5% | | Al, Zn | Al, Zn | Al, Zn | Al, Zn |
| fluctuation element/min.-max. | (mass %) | Al/2.70-2.78 | Al/2.70-2.78 | Al/2.70-2.78 | Al/5.95-6.07 |
| element/compositional average | (%) | Al/2.7% | Al/2.7% | Al/2.7% | Al/2.0% |
| element/min.-max. | (mass %) | Zn/0.81-0.89 | Zn/0.81-0.89 | Zn/0.81-0.89 | Zn/0.81-0.89 |
| element/compositional average | (%) | Zn/0.81-0.89 | Zn/0.81-0.89 | Zn/0.81-0.89 | Zn/0.81-0.89 |
| relation: fluctuation ≦ 10% | (○/X) | ○ | ○ | ○ | ○ |
| surface defect depth/plate thickness | (%) | 0.80% | 0.90% | 1.05% | 1.20% |
| tensile strength | (MPa) | 296 | 288 | 301 | 331 |
| breaking elongation | (%) | 10.4 | 9.6 | 8.5 | 7.8 |

TABLE 7

| item | unit | sample No., composition (mass %) | | | |
|---|---|---|---|---|---|
| | | No. 5<br>Mg<br>8 mass % Al<br>0.6 mass % Zn<br>0.03 mass % Ca | No. 6<br>Mg<br>9 mass % Al<br>1 mass % Zn<br>0.03 mass % Ca | No. 7<br>Mg<br>4 mass % Al<br>1 mass % Si | No. 8<br>Mg<br>2.5 mass % Zn<br>7 mass % Y |
| Rolling conditions | | | | | |
| plate thickness before rolling | (mm) | 3.9 | 4.8 | 4.5 | 4.4 |
| total reduction rate | (%) | 87% | 90% | 89% | 89% |
| max value of 1-pass reduction rate c | (%) | 15 | 15 | 15 | 15 |
| min value of 1-pass reduction rate c | (%) | 6 | 6 | 6 | 6 |
| step meeting relation 50 ≧ c ≧ 1 present? | (○/X) | ○ | ○ | ○ | ○ |
| surface temp of rolling rolls in last pass | (° C.) | 175 | 175 | 175 | 175 |
| material temp. t1 before rolling in last pass | (° C.) | 20 | 20 | 20 | 20 |
| material temp. t2 after rolling in last pass | (° C.) | 165 | 165 | 165 | 165 |
| T | (° C.) | 165 | 165 | 165 | 165 |
| reduction rate c in last pass | (%) | 6 | 6 | 6 | 6 |
| relation T/c | (○/X) | 27.5 | 27.5 | 27.5 | 27.5 |
| Rolled material characteristics | | | | | |
| thickness | (mm) | 0.5 | 0.5 | 0.5 | 0.5 |
| average crystal grain size | (μm) | 3.52 | 3.504 | 3.74 | 3.3 |
| average crystal grain size in surface part | (μm) | 3.2 | 3.2 | 3.4 | 3 |
| average crystal grain size in central part | (μm) | 3.84 | 3.808 | 4.08 | 3.6 |
| difference in average crystal grain size between surface and central parts | (μm) | 0.64 | 0.608 | 0.68 | 0.6 |
| relation (difference in average crystal grain size between surface and central parts ≦ 20%) | (%) | 18.2%: ○ | 17.4%: ○ | 18.2%: ○ | 18.2%: ○ |
| max size of intermetallic compounds | (μm) | 5 | 5 | 15 | 6.7 |

TABLE 7-continued

| item | | unit | sample No., composition (mass %) | | | |
|---|---|---|---|---|---|---|
| | | | No. 5<br>Mg<br>8 mass % Al<br>0.6 mass % Zn<br>0.03 mass % Ca | No. 6<br>Mg<br>9 mass % Al<br>1 mass % Zn<br>0.03 mass % Ca | No. 7<br>Mg<br>4 mass % Al<br>1 mass % Si | No. 8<br>Mg<br>2.5 mass % Zn<br>7 mass % Y |
| component | element contained at least by 0.5% | | Al, Zn | Al, Zn | Al, Si | Zn, Y |
| fluctuation | element/min.-max. | (mass %) | Al/8.00-8.15 | Al/8.82-9.08 | Al/4.10-4.21 | Zn/2.35-2.51 |
| | element/compositional average | (%) | Al/1.9% | Al/2.9% | Al/2.8% | Zn/6.4% |
| | element/min.-max. | (mass %) | Zn/0.62-0.65 | Zn/0.81-0.89 | Si/1.05-1.08 | Y/6.51-6.73 |
| | element/compositional average | (%) | Zn/0.62-0.65 | Zn/0.81-0.89 | Si/1.05-1.08 | Y/6.51-6.73 |
| | relation: fluctuation ≦ 10% | (○/X) | ○ | ○ | ○ | ○ |
| surface defect depth/plate thickness | | (%) | 1.10% | 0.60% | 1.20% | 3.20% |
| tensile strength | | (MPa) | 360 | 395 | 350 | 345 |
| breaking elongation | | (%) | 8.2 | 8.6 | 5.1 | 5.3 |

TABLE 8

| item | | unit | sample No., composition (mass %) | | | |
|---|---|---|---|---|---|---|
| | | | No. 9<br>Mg<br>3 mass % Al<br>1 mass % Zn<br>0.03 mass % Ca | No. 10<br>Mg<br>0.03 mass % Ca | No. 11<br>Mg<br>3 mass % Al<br>1 mass % Zn<br>0.03 mass % Ca | No. 12<br>Mg<br>3 mass % Al<br>1 mass % Zn<br>0.03 mass % Ca |
| Rolling conditions | | | | | | |
| plate thickness before rolling | | (mm) | 3.5 | 1.4 | 5 | 3.8 |
| total reduction rate | | (%) | 97% | 86% | 98% | 47% |
| max value of 1-pass reduction rate c | | (%) | 25 | 25 | 25 | 25 |
| min value of 1-pass reduction rate c | | (%) | 9 | 9 | 9 | 9 |
| step meeting relation 50 ≧ c ≧ 1 present? | | (○/X) | ○ | ○ | ○ | ○ |
| surface temp of rolling rolls in last pass | | (° C.) | 175 | 175 | 175 | 175 |
| material temp. t1 before rolling in last pass | | (° C.) | 20 | 20 | 20 | 20 |
| material temp. t2 after rolling in last pass | | (° C.) | 165 | 165 | 165 | 165 |
| T | | (° C.) | 165 | 165 | 165 | 165 |
| reduction rate c in last pass | | (%) | 9 | 9 | 9 | 9 |
| relation T/c | | (○/X) | 18.3 | 18.3 | 18.3 | 18.3 |
| Rolled material characteristics | | | | | | |
| thickness | | (mm) | 0.1 | 0.2 | 0.1 | 2 |
| average crystal grain size | | (μm) | 3.255 | 3.36 | 3.255 | 3.255 |
| average crystal grain size in surface part | | (μm) | 3.1 | 3.2 | 3.1 | 3.1 |
| average crystal grain size in central part | | (μm) | 3.41 | 3.52 | 3.41 | 3.41 |
| difference in average crystal grain size between surface and central parts | | (μm) | 0.31 | 0.32 | 0.31 | 0.31 |
| relation (difference in average crystal grain size between surface and central parts ≦ 20%) | | (%) | 9.5%: ○ | 9.5%: ○ | 9.5%: ○ | 9.5%: ○ |
| max size of intermetallic compounds | | (μm) | 20 | none | none | none |
| component | element contained at least by 0.5% | | Al, Zn | — | Al, Zn | Al, Zn |
| fluctuation | element/min.-max. | (mass %) | Al/2.70-2.78 | — | Al/2.70-2.78 | Al/2.70-2.78 |
| | element/compositional average | (%) | Al/2.7% | — | Al/2.7% | Al/2.7% |
| | element/min.-max. | (mass %) | Zn/0.81-0.89 | — | Zn/0.81-0.89 | Zn/0.81-0.89 |
| | element/compositional average | (%) | Zn/0.81-0.89 | — | Zn/0.81-0.89 | Zn/0.81-0.89 |
| | relation: fluctuation ≦ 10% | (○/X) | ○ | ○ | ○ | ○ |
| surface defect depth/plate thickness | | (%) | 0.09% | 0.10% | 0.90% | 1.15% |
| tensile strength | | (MPa) | 286 | 275 | 296 | 265 |
| breaking elongation | | (%) | 10.4 | 11.2 | 10.2 | 8.7 |

TABLE 9

| item | unit | sample No., composition (mass %) | | | |
|---|---|---|---|---|---|
| | | No. 13 Mg 4 mass % Al 2 mass % Si | No. 14 Mg 4 mass % Al 5 mass % Si | No. 15 Mg 9 mass % Al 2 mass % Si | No. 16 Mg 6 mass % Zn 0.4 mass % Zr |
| Rolling conditions | | | | | |
| plate thickness before rolling | (mm) | 3.5 | 3.5 | 3.5 | 3.5 |
| total reduction rate | (%) | 86% | 86% | 90% | 86% |
| max value of 1-pass reduction rate c | (%) | 25 | 25 | 25 | 25 |
| min value of 1-pass reduction rate c | (%) | 9 | 9 | 8 | 9 |
| step meeting relation 50 ≧ c ≧ 1 present? | (○/X) | ○ | ○ | ○ | ○ |
| surface temp of rolling rolls in last pass | (° C.) | 175 | 175 | 175 | 175 |
| material temp. t1 before rolling in last pass | (° C.) | 20 | 20 | 20 | 20 |
| material temp. t2 after rolling in last pass | (° C.) | 165 | 165 | 165 | 165 |
| T | (° C.) | 165 | 165 | 165 | 165 |
| reduction rate c in last pass | (%) | 9 | 9 | 8 | 9 |
| relation T/c | (○/X) | 18.3 | 18.3 | 18.3 | 18.3 |
| Rolled material characteristics | | | | | |
| thickness | (mm) | 0.5 | 0.5 | 0.5 | 3.5 |
| average crystal grain size | (μm) | 4.255 | 4.255 | 4.36 | 4.255 |
| average crystal grain size in surface part | (μm) | 4.10 | 4.10 | 4.20 | 4.10 |
| average crystal grain size in central part | (μm) | 4.41 | 4.41 | 4.52 | 4.41 |
| difference in average crystal grain size between surface and central parts | (μm) | 0.31 | 0.31 | 0.32 | 0.31 |
| relation (difference in average crystal grain size between surface and central parts ≦ 20%) | (%) | 7.5%: ○ | 7.5%: ○ | 7.0%: ○ | 7.5%: ○ |
| max size of intermetallic compounds | (μm) | 0.9 | 0.9 | 3 | 1.2 |
| component element contained at least by 0.5% | | Al, Si | Al, Si | Al, Si | Zn |
| fluctuation element/min.-max. | (mass %) | Al/3.99-4.11 | Al/3.99-4.11 | Al/8.79-9.06 | Zn/5.70-5.78 |
| element/compositional average | (%) | Al/2.8% | Al/2.8% | Al/3.0% | Zn/1.3% |
| element/min.-max. | (mass %) | Si/1.83-1.95 | Si/4.83-4.95 | Si/1.83-1.95 | — |
| element/compositional average | (%) | Si/6.0% | Si/2.4% | Si/6.0% | — |
| relation: fluctuation ≦ 10% | (○/X) | ○ | ○ | ○ | ○ |
| surface defect depth/plate thickness | (%) | 0.02 | 0.02 | 0.07 | 0.12 |
| tensile strength | (MPa) | 314 | 364 | 410 | 322 |
| breaking elongation | (%) | 13.4 | 8.4 | 7.2 | 12.2 |

TABLE 10

| item | unit | sample No., composition (mass %) | | | |
|---|---|---|---|---|---|
| | | No. 17 Mg 9 mass % Al 1.5 mass % Ca | No. 18 Mg 5 mass % Al 3 mass % Ca | No. 19 Mg 5 mass % Al 10 mass % Ca | No. 20 Mg 4 mass % Al 2 mass % Si 0.8 mass % Ca |
| Rolling conditions | | | | | |
| plate thickness before rolling | (mm) | 3.5 | 3.5 | 3.5 | 3.5 |
| total reduction rate | (%) | 86% | 90% | 87% | 86% |
| max value of 1-pass reduction rate c | (%) | 25 | 25 | 15 | 25 |
| min value of 1-pass reduction rate c | (%) | 9 | 8 | 8 | 9 |
| step meeting relation 50 ≧ c ≧ 1 present? | (○/X) | ○ | ○ | ○ | ○ |
| surface temp of rolling rolls in last pass | (° C.) | 175 | 175 | 175 | 175 |
| material temp. t1 before rolling in last pass | (° C.) | 20 | 20 | 20 | 20 |
| material temp. t2 after rolling in last pass | (° C.) | 165 | 165 | 165 | 165 |
| T | (° C.) | 165 | 165 | 165 | 165 |
| reduction rate c in last pass | (%) | 9 | 8 | 8 | 9 |
| relation T/c | (○/X) | 18.3 | 18.3 | 18.3 | 18.3 |
| Rolled material characteristics | | | | | |
| thickness | (mm) | 0.5 | 0.5 | 0.5 | 0.5 |
| average crystal grain size | (μm) | 4.255 | 4.36 | 4.010 | 4.255 |
| average crystal grain size in surface part | (μm) | 4.10 | 4.20 | 3.90 | 4.10 |
| average crystal grain size in central part | (μm) | 4.41 | 4.52 | 4.21 | 4.41 |
| difference in average crystal grain size between surface and central parts | (μm) | 0.31 | 0.32 | 0.71 | 0.31 |
| relation (difference in average crystal grain size between surface and central parts ≦ 20%) | (%) | 7.5%: ○ | 7.0%: ○ | 7.3%: ○ | 7.5%: ○ |
| max size of intermetallic compounds | (μm) | 1.5 | 1.2 | 2.1 | 0.9 |
| component element contained at least by 0.5% | | Al, Ca | Al, Ca | Al, Ca | Al, Si |

TABLE 10-continued

| item | | unit | sample No., composition (mass %) | | | |
|---|---|---|---|---|---|---|
| | | | No. 17 Mg 9 mass % Al 1.5 mass % Ca | No. 18 Mg 5 mass % Al 3 mass % Ca | No. 19 Mg 5 mass % Al 10 mass % Ca | No. 20 Mg 4 mass % Al 2 mass % Si 0.8 mass % Ca |
| fluctuation | element/min.-max. | (mass %) | Al/8.70-8.78 | Al/4.70-4.78 | Al/4.70-4.78 | Al/3.99-4.11 |
| | element/compositional average | (%) | Al/0.9% | Al/1.6% | Al/1.6% | Al/2.8% |
| | element/min.-max. | (mass %) | Ca/1.43-1.51 | Ca/2.99-3.05 | Ca/9.81-9.89 | Si/1.83-1.95 |
| | element/compositional average | (%) | Ca/5.3% | Ca/2.0% | Ca/0.8% | Si/6.0% |
| | relation: fluctuation ≦ 10% | (○/X) | ○ | ○ | ○ | ○ |
| surface defect depth/plate thickness | | (%) | 0.01 | 0.02 | 0.07 | 0.02 |
| tensile strength | | (MPa) | 405 | 321 | 341 | 325 |
| breaking elongation | | (%) | 12.2 | 9.3 | 8.7 | 13.5 |

As shown in Tables 6 to 10, the obtained rolled materials are excellent in the surface quality and also in the strength and tenacity. Also the materials had a fine crystal structure and showed fine intermetallic compounds. Also when the cast materials of Nos. 1 to 20 are subjected to a solution treatment at a temperature suitable for each composition within a temperature range of from 300 to 600° C. for 1 hour or longer, and are further subjected to a rolling and a heat treatment under similar conditions as above, and the characteristics are investigated in a similar manner. As a result, unexpected cracking, strain or deformation did not occur at all during the rolling, and the rolling work could be executed in more stable manner.

TEST EXAMPLE 3

The obtained rolled materials are subjected to a pressing work (into an ordinary case shape) at 250° C. to prepare magnesium alloy formed articles. As a result, the formed articles utilizing the aforementioned rolled materials had an excellent dimensional precision, without cracking. Also among the rolled materials, certain samples are selected (Nos. 1-4, 9-13, 15, 16, 18 and 20 being selected) and subjected to a pressing work of various shapes at 250° C. These rolled materials are capable of pressing in any shape, and are excellent in external appearance and dimensional precision. As a comparison, a commercially available AZ31 alloy material is similarly subjected to pressing works in various shapes. As a result, the AZ31 alloy material is incapable of pressing due to cracking, or provided a product of an inferior appearance even when the pressing work is possible.

TEST EXAMPLE 4

Also among the rolled materials, certain samples are selected (Nos. 5 and 6 being selected) and investigated for corrosion resistance. These samples are confirmed to have a corrosion resistance, comparable to that of an AZ91 alloy material, prepared by an ordinary thixomold method.

TEST EXAMPLE 5

Also among the rolled materials, certain samples are selected (Nos. 1, 6, 7, 13 and 18 being selected) and evaluated for a bending amount. On two parallel projections, which are positioned at a distance of 150 mm, has a height of 20 mm and a sharp upper end, a sample of a width of 30 mm, a length of 200 mm and a thickness of 0.5 mmt is placed perpendicularly to the projections, and a decrease in the height at a center, when a predetermined load is applied at the center of the projections, is divided by a decrease in the height, measured in a same method on a commercial AZ31 alloy plate of 0.5 mmt, and is represented by a percentage. As a result, as shown in Table 12, the samples prepared by a twin-roll casting are confirmed to have a bending resistance, equal to or higher than that of the commercial AZ31 alloy.

TEST EXAMPLE 6

Furthermore, among the rolled materials, certain samples are selected (Nos. 1, 6, 7, 13 and 18 being selected), and same compositions are molten with a carbon crucible in an argon atmosphere, then cast in a SUS316 mold, coated with a graphite releasing agent, with a cooling rate of from 1 to 10 K/sec so as to obtain a shape of 100 mm×200 mm×20 mmt, then subjected to a homogenization process at 400° C. for 24 hours in the air, and subjected to a cutting work to obtain test pieces of a thickness of 4 mmt, without defects on the surface and in the interior (in Table 11, represented as Nos. 1_M1, 6_M1, 7_M1, 13_M1 and 18_M1). The prepared test piece is subjected to a rolling work to 0.5 mmt so as to satisfy a relation 100>(T/c)>5 wherein c (%) is a one-pass reduction rate, and T (° C.) is a higher one of a temperature t1 (° C.) of the material before the rolling and a temperature t2 (° C.) of the material at the rolling operation. As a result, as shown in Table 11, the magnesium alloys cast with a cooling rate of from 1 to 10 K/sec showed cracking in the rolling process and could not be rolled, except for the alloy of the composition No. 1.

TEST EXAMPLE 7

Furthermore, among the rolled materials, certain samples are selected (Nos. 1, 6, 7, 13 and 18 being selected), and same compositions are molten with a carbon crucible in an argon atmosphere, then cast in a SUS316 mold, coated with a graphite releasing agent, with a cooling rate of from 1 to 10 K/sec so as to obtain a shape of 100 mm×200 mm×20 mmt, then subjected to a homogenization process at 400° C. for 24 hours in the air, and subjected to a cutting work to obtain test pieces of a thickness of 0.5 mmt, without defects on the surface and in the interior (in Table 11, represented as Nos. 1_M2, 6_M2, 7_M2, 13_M2 and 18_M2). Among thus prepared samples and the aforementioned rolled materials, certain samples (Nos. 1, 6, 7, 13, 18 and 1_M1 being selected) are investigated for mechanical characteristics at the room temperature, 200° C. and 250° C., and for a creep property at 150° C. The creep property is evaluated after holding the test piece in an environment of 150°±2° C. for 20 hours, and is represented by a percentage to a creep stress (a stress (MPa) generating a creep rate of 0.1%/1000 h at a constant temperature) of a commercial AZ 31 alloy plate. As a result, as shown in Table 12, the samples prepared by the twin-roll casting are confirmed to show an excellent heat resistance.

TABLE 11

| item | | unit | sample No., composition (mass %) | | | | |
|---|---|---|---|---|---|---|---|
| | | | No. 1<br>Mg<br>3 mass % Al<br>1 mass % Zn<br>0.03 mass % Ca | No. 6<br>Mg<br>9 mass % Al<br>1 mass % Zn<br>0.03 mass % Ca | No. 7<br>Mg<br>4 mass % Al<br>1 mass % Si | No. 13<br>Mg<br>4 mass % Al<br>2 mass % Si | No. 18<br>Mg<br>5 mass % Al<br>3 mass % Ca |
| Twin-roll cast-rolled material | | | | | | | |
| plate thickness before rolling | | (mm) | 4.3 | 4.8 | 4.5 | 3.5 | 3.5 |
| total reduction rate | | (%) | 88% | 90% | 89% | 86% | 90% |
| thickness | | (mm) | 0.5 | 0.5 | 0.5 | 0.5 | 0.5 |
| average crystal grain size | | (μm) | 3.3 | 3.504 | 3.74 | 4.255 | 4.36 |
| max size of intermetallic compounds | | (μm) | none | 5 | 15 | 0.9 | 1.2 |
| component | element contained at least by 0.5% | | Al, Zn | Al, Zn | Al, Si | Al, Si | Al, Ca |
| fluctuation | element/min.-max. | (mass %) | Al/2.70-2.78 | Al/8.82-9.08 | Al/4.10-4.21 | Al/3.99-4.11 | Al/4.70-4.78 |
| | element/compositional average | (%) | Al/2.7% | Al/2.9% | Al/2.8% | Al/2.8% | Al/1.6% |
| | element/min.-max. | (mass %) | Zn/0.81-0.89 | Zn/0.81-0.89 | Si/1.05-1.08 | Si/1.83-1.95 | Ca/2.99-3.05 |
| | element/compositional average | (%) | Zn/0.81-0.89 | Zn/0.81-0.89 | Si/1.05-1.08 | Si/6.0% | Ca/2.0% |
| | relation: fluctuation ≦ 10% | (○/X) | ○ | ○ | ○ | ○ | ○ |

| item | | unit | sample No., composition (mass %) | | | | |
|---|---|---|---|---|---|---|---|
| | | | No. 1_M1<br>Mg<br>3 mass % Al<br>1 mass % Zn<br>0.03 mass % Ca | No. 6_M1<br>Mg<br>9 mass % Al<br>1 mass % Zn<br>0.03 mass % Ca | No. 7_M1<br>Mg<br>4 mass % Al<br>1 mass % Si | No. 13_M1<br>Mg<br>4 mass % Al<br>2 mass % Si | No. 18_M1<br>Mg<br>5 mass % Al<br>3 mass % Ca |
| SUS mold cast-rolled material | | | | | | | |
| plate thickness before rolling | | (mm) | 4.0 | 4.0 | 4.0 | 4.0 | 4.0 |
| total reduction rate | | (%) | 87% | cracked in rolling work to 0.5 mmt | | | |
| thickness | | (mm) | 0.5 | | | | |
| average crystal grain size | | (μm) | 3.52 | | | | |
| max size of intermetallic compounds | | (μm) | 20 | | | | |
| component | element contained at least by 0.5% | | Al, Zn | Al, Zn | Al, Si | Al, Si | Al, Ca |
| fluctuation | element/min.-max. | (mass %) | Al/2.70-2.78 | Al/8.82-9.08 | Al/4.10-4.21 | Al/3.99-4.11 | Al/4.70-4.78 |
| | element/compositional average | (%) | Al/2.7% | Al/2.9% | Al/2.8% | Al/2.8% | Al/1.6% |
| | element/min.-max. | (mass %) | Zn/0.81-0.89 | Zn/0.81-0.89 | Si/1.05-1.08 | Si/1.83-1.95 | Ca/2.99-3.05 |
| | element/compositional average | (%) | Zn/0.81-0.89 | Zn/0.81-0.89 | Si/1.05-1.08 | Si/6.0% | Ca/2.0% |
| | relation: fluctuation ≦ 10% | (○/X) | ○ | ○ | ○ | ○ | ○ |

| item | | unit | sample No., composition (mass %) | | | | |
|---|---|---|---|---|---|---|---|
| | | | No. 1_M2<br>Mg<br>3 mass % Al<br>1 mass % Zn<br>0.03 mass % Ca | No. 6_M2<br>Mg<br>9 mass % Al<br>1 mass % Zn<br>0.03 mass % Ca | No. 7_M2<br>Mg<br>4 mass % Al<br>1 mass % Si | No. 13_M2<br>Mg<br>4 mass % Al<br>2 mass % Si | No. 18_M2<br>Mg<br>5 mass % Al<br>3 mass % Ca |
| SUS mold cast-cut material | | | | | | | |
| thickness | | (mm) | 0.5 | 0.5 | 0.5 | 0.5 | 0.5 |
| average crystal grain size | | (μm) | 25 | 28 | 25 | 25 | 25 |
| max size of intermetallic compounds | | (μm) | 20 | 35 | 15 | 15 | 30 |
| component | element contained at least by 0.5% | | Al, Zn | Al, Zn | Al, Si | Al, Si | Al, Ca |
| fluctuation | element/min.-max. | (mass %) | Al/2.70-2.78 | Al/8.82-9.08 | Al/4.10-4.21 | Al/3.99-4.11 | Al/4.70-4.78 |
| | element/compositional average | (%) | Al/2.7% | Al/2.9% | Al/2.8% | Al/2.8% | Al/1.6% |
| | element/min.-max. | (mass %) | Zn/0.81-0.89 | Zn/0.81-0.89 | Si/1.05-1.08 | Si/1.83-1.95 | Ca/2.99-3.05 |
| | element/compositional average | (%) | Zn/0.81-0.89 | Zn/0.81-0.89 | Si/1.05-1.08 | Si/6.0% | Ca/2.0% |
| | relation: fluctuation ≦ 10% | (○/X) | ○ | ○ | ○ | ○ | ○ |

TABLE 12

| item | | unit | sample No., composition (mass %) Twin-roll cast-rolled material | | | | |
|---|---|---|---|---|---|---|---|
| | | | No. 1 Mg 3 mass % Al 1 mass % Zn 0.03 mass % Ca | No. 6 Mg 9 mass % Al 1 mass % Zn 0.03 mass % Ca | No. 7 Mg 4 mass % Al 1 mass % Si | No. 13 Mg 4 mass % Al 2 mass % Si | No. 18 Mg 5 mass % Al 3 mass % Ca |
| mechanical characteristics | tensile strength (room temp.) | (MPa) | 296.2 | 395.1 | 350.0 | 314.3 | 321.0 |
| | breaking elongation (room temp.) | (%) | 10.4 | 8.6 | 5.1 | 13.4 | 9.3 |
| | tensile strength (200° C.) | (MPa) | 108.4 | 131.2 | 120.2 | 129.7 | 128.5 |
| | breaking elongation (200° C.) | (%) | 98.1 | 90.1 | 89.3 | 73.6 | 85.2 |
| | tensile strength (250° C.) | (MPa) | 69.1 | 75.5 | 86.7 | 92.9 | 81.2 |
| | breaking elongation (250° C.) | (%) | 144.5 | 214.3 | 119.4 | 95.1 | 128.7 |
| creep property | | (%) | 110 | 150 | 780 | 1020 | 1130 |
| bend resistance | bending amount | | 95 | 90 | 85 | 80 | 80 |

| item | | unit | sample No., composition (mass %) SUS mold cast-rolled material | | | | |
|---|---|---|---|---|---|---|---|
| | | | No. 1_M1 Mg 3 mass % Al 1 mass % Zn 0.03 mass % Ca | No. 6_M1 Mg 9 mass % Al 1 mass % Zn 0.03 mass % Ca | No. 7_M1 Mg 4 mass % Al 1 mass % Si | No. 13_M1 Mg 4 mass % Al 2 mass % Si | No. 18_M1 Mg 5 mass % Al 3 mass % Ca |
| mechanical characteristics | tensile strength (room temp.) | (MPa) | 268.2 | cracked in rolling work to 0.5 mmt | | | |
| | breaking elongation (room temp.) | (%) | 9.6 | | | | |
| | tensile strength (200° C.) | (MPa) | 98.4 | | | | |
| | breaking elongation (200° C.) | (%) | 65.9 | | | | |
| | tensile strength (250° C.) | (MPa) | 60.1 | | | | |
| | breaking elongation (250° C.) | (%) | 78.3 | | | | |
| creep property | | (%) | 101 | | | | |

| item | | unit | sample No., composition (mass %) SUS mold cast-cut material | | | | |
|---|---|---|---|---|---|---|---|
| | | | No. 1_M2 Mg 3 mass % Al 1 mass % Zn 0.03 mass % Ca | No. 6_M2 Mg 9 mass % Al 1 mass % Zn 0.03 mass % Ca | No. 7_M2 Mg 4 mass % Al 1 mass % Si | No. 13_M2 Mg 4 mass % Al 2 mass % Si | No. 18_M2 Mg 5 mass % Al 3 mass % Ca |
| mechanical characteristics | tensile strength (room temp.) | (MPa) | 132.3 | 258.8 | 134.6 | 138.3 | 125.6 |
| | breaking elongation (room temp.) | (%) | 5.6 | 8.1 | 3.2 | 2.8 | 3.4 |
| | tensile strength (200° C.) | (MPa) | 85.1 | 107.5 | 102.2 | 110.9 | 122.2 |
| | breaking elongation (200° C.) | (%) | 28.4 | 28.0 | 25.1 | 16.1 | 16.8 |
| | tensile strength (250° C.) | (MPa) | 57.3 | 64.1 | 78.7 | 70.5 | 73.2 |
| | breaking elongation (250° C.) | (%) | 38.1 | 72.1 | 35.9 | 19.6 | 23.2 |
| creep property | | (%) | 80 | 85 | 300 | 500 | 600 |

INDUSTRIAL APPLICABILITY

The producing method of the present invention for magnesium alloy material is capable of stably producing magnesium alloy materials such as a magnesium alloy cast material and a magnesium alloy rolled material, excellent in mechanical characteristics, a surface quality, a bending resistance, a corrosion resistance, and a creep property. The obtained rolled material has an excellent plastic working property as in a pressing or a forging, and is optimum as a material for such molding process. Also the obtained magnesium alloy molded article can be utilized in structural members and decorative articles in the fields relating to household electric appliances, transportation, aviation-space, sports-leisure, medical-welfare, foods, and construction.

The invention claimed is:

1. A method for producing a magnesium alloy material, the method comprising:

a melting step of melting a magnesium alloy in a melting furnace to obtain a molten metal;

a transfer step of transferring the molten metal from the melting furnace to a molten metal reservoir; and a casting step of supplying a movable mold with the molten metal from the molten metal reservoir through a pouring gate and solidifying the molten metal to continuously produce a cast material of a thickness of from 0.1 to 10 mm, wherein in a process from the melting step to the casting step, all parts contacted by the molten metal are formed by a low-oxygen material having an oxygen content of 20 mass % or less, the low-oxygen material is one or more selected from a carbon-based material, molybdenum, silicon carbide, boron nitride, copper, a copper alloy, iron, steel and stainless steel, and wherein the part contacted by the molten metal includes a surface part in the melting furnace a surface part of a transfer gutter between the melting furnace and the molten metal reservoir, a surface part of the molten metal reservoir, a surface part of a supply part between the molten metal reservoir and a movable mold, and a surface part of the movable mold.

2. The method for producing a magnesium alloy material according to claim 1, wherein the movable mold is formed by a material meeting a following condition for electrical conductivity:

$$100 \geqq y > x - 10$$

wherein y represents an electrical conductivity of the movable mold, and x represents an electrical conductivity of the magnesium alloy material.

3. The method for producing a magnesium alloy material according to claim 1, wherein the movable mold includes, on a surface thereof, a cover layer meeting a following condition for electrical conductivity:

$$100 \geqq y' > x - 10$$

wherein y' represents an electrical conductivity of a material constituting the cover layer, and x represents an electrical conductivity of the magnesium alloy material.

4. The method for producing a magnesium alloy material according to claim 1, wherein the movable mold includes, on a surface thereof, a metal cover layer formed by a material, containing an alloy composition of the magnesium alloy material by 50 mass % or more.

5. The method for producing a magnesium alloy material according to claim 1, wherein in the casting step, the movable mold has a surface temperature equal to or lower than 50% of a melting point of the material constituting the movable mold.

6. The method for producing a magnesium alloy material according to claim 1, wherein at least one of an interior of the melting furnace, an interior of the molten metal reservoir and an interior of the transfer gutter between the melting furnace and the molten metal reservoir is maintained in a low-oxygen atmosphere; and the atmosphere has an oxygen concentration less than an oxygen concentration in the air.

7. The method for producing a magnesium alloy material according to claim 6, wherein the atmosphere contains oxygen of less than 5 vol %, and a remaining gas contains at least one of nitrogen, argon and carbon dioxide in an amount of 95 vol % or more.

8. The method for producing a magnesium alloy material according to claim 1, wherein the magnesium alloy contains one or more elements selected from a group of Al, Zn, Mn, Y, Zr, Cu, Ag and Si, in an amount equal to or larger than 0.01 mass % and less than 20 mass % per element, and a remainder constituted of Mg and an impurity, Mg being present in an amount equal to or larger than 50 mass %.

9. The method for producing a magnesium alloy material according to claim 8, wherein the magnesium alloy further contains Ca in an amount equal to or larger than 0.001 mass % and less than 16 mass %.

10. The method for producing a magnesium alloy material according to claim 8, wherein the magnesium alloy further contains one or more elements selected from a group of Ca, Ni, Au, Pt, Sr, Ti, B, Bi, Ge, In, Te, Nd, Nb, La and RE in an amount equal to or larger than 0.001 mass % and less than 5 mass % per element.

11. The method for producing a magnesium alloy material according to claim 1, wherein the molten metal is agitated in at least one of the melting furnace, the transfer gutter for transferring the molten metal from the melting furnace to the molten metal reservoir and the molten metal reservoir.

12. The method for producing a magnesium alloy material according to claim 1, wherein the molten metal, when supplied from the pouring gate to the movable mold has a pressure of equal to or larger than 101.8 kPa and less than 118.3 kPa.

13. The method for producing a magnesium alloy material according to claim 12, wherein the movable mold is constituted of a pair of rolls, rotated in mutually different directions and so positioned that a center line of a gap between the rolls becomes horizontal;

the molten metal is supplied in a horizontal direction from the molten metal reservoir to the gap between the rolls through the pouring gate;

the supply of the molten metal to the gap between the rolls is executed by a weight of the molten metal; and a liquid level of the molten metal in the molten metal reservoir is at a position higher, by 30 mm or more, than the center line of the gap between the rolls.

14. The method for producing a magnesium alloy material according to claim 13, wherein a height, higher by 30 mm or more from the center line of the gap between the rolls is selected as a set value for the liquid level of the molten metal; and the liquid level of the molten metal in the molten metal reservoir is so controlled as to be within a range of the set value ±10%.

15. The method for producing a magnesium alloy material according to claim 1, wherein the molten metal at the pouring gate is maintained at a temperature equal to or higher than a melting point +10° C. and equal to or lower than a melting point +85° C.

16. The method for producing a magnesium alloy material according to claim 1, wherein the molten metal has a temperature fluctuation within 10° C. in a transversal cross-sectional direction of the pouring gate.

17. The method for producing a magnesium alloy material according to claim 1, wherein a cooling rate at a solidification is within a range of from 50 to 10,000 K/sec.

18. The method for producing a magnesium alloy material according to claim 1, wherein the movable mold is constituted of a pair of rolls which rotate in mutually different directions and are positioned in an opposed relationship.

19. The method for producing a magnesium alloy material according to claim 18, wherein a distance between a plane including the rotary axes of the rolls and a distal end of the pouring gate is 2.7% or less of an entire circumferential length of the roll.

20. The method for producing a magnesium alloy material according to claim 18, wherein a distance between distal ends of an external periphery of the pouring gate is from 1 to 1.55 times of a minimum gap between the rolls.

21. The method for producing a magnesium alloy material according to claim 1, wherein the solidification of the molten metal is completed at a discharge thereof from the movable mold.

22. The method for producing a magnesium alloy material according to claim 21, wherein the movable mold is constituted of a pair of rolls which rotate in mutually different directions and are positioned in an opposed relationship; and the solidification of the molten metal is completed within a range of from 15 to 60% of a distance, from a plane including the rotary axes of the rolls to a distal end of the pouring gate.

23. The method for producing a magnesium alloy material according to claim 21, wherein a surface temperature of the magnesium alloy material discharged from the movable mold is 400° C. or lower.

24. The method for producing a magnesium alloy material according to claim 21, wherein a compression load applied to the movable mold by the solidified magnesium alloy material is, in a transversal direction of the magnesium alloy material, within a range of from 1,500 to 7,000 N/mm.

25. The method for producing a magnesium alloy material according to claim 1, further comprising:

a heat treatment step of applying a heat treatment to a cast material obtained by the casting step.

26. A magnesium alloy cast material obtained by the method according to claim 1.

27. The method for producing a magnesium alloy material according to claim 1, further comprising:

a rolling step of applying a rolling work with rolling rolls on a cast material obtained by the casting step.

28. The method for producing a magnesium alloy material according to claim 27, wherein a total reduction rate C is 20% or higher, the total reduction rate C being represented by C (%)=(A−B)/A×100 in which A (mm) represents a thickness of the cast material and B (mm) represents a thickness of the rolled material.

29. The method for producing a magnesium alloy material according to claim 27, wherein the rolling step includes a rolling pass having a one-pass reduction rate c of from 1 to 50%, the one-pass reduction rate c being represented by c (%)=(a−b)/a×100 in which a (mm) represents a thickness of a material before rolling and b (mm) represents a thickness of the material after rolling.

30. The method for producing a magnesium alloy material according to claim 27, wherein the rolling step includes a rolling pass in which a surface temperature of the material is 100° C. or less immediately before introduction into the rolling rolls, and a surface temperature of the rolling rolls is from 100 to 300° C.

31. The method for producing a magnesium alloy material according to any one of claims 27 to 30, further comprising:

a heat treatment step of applying a heat treatment to a rolled material subjected to the rolling work.

32. The method for producing a magnesium alloy material according to claim 27 comprising:

a plastic working step of applying a plastic working on the magnesium alloy rolled material; and a heat treatment step of applying a heat treatment to the material subjected to the plastic working.

33. The method for producing a magnesium alloy material according to claim 32, wherein the plastic working step executes a pressing work or a forging work on the rolled material within a temperature range equal to or higher than a room temperature and less than 500° C.

34. The method for producing a magnesium alloy material according to claim 1, wherein a surface part of the supply part is one or more selected from a carbon-based material, silicon carbide and boron nitride.

* * * * *